US010210875B2

(12) United States Patent
Hardwick et al.

(10) Patent No.: US 10,210,875 B2
(45) Date of Patent: Feb. 19, 2019

(54) AUDIO WATERMARKING VIA PHASE MODIFICATION

(71) Applicant: Digital Voice Systems, Inc., Westford, MA (US)

(72) Inventors: John C. Hardwick, Sudbury, MA (US); Daniel W. Griffin, Hollis, NH (US)

(73) Assignee: Digital Voice Systems, Inc., Westford, MA (US)

( * ) Notice: Subject to any disclaimer, the term of this patent is extended or adjusted under 35 U.S.C. 154(b) by 0 days.

(21) Appl. No.: 16/000,381

(22) Filed: Jun. 5, 2018

(65) Prior Publication Data

US 2018/0286417 A1 Oct. 4, 2018

Related U.S. Application Data

(62) Division of application No. 14/702,536, filed on May 1, 2015, now Pat. No. 9,990,928.

(60) Provisional application No. 62/103,885, filed on Jan. 15, 2015, provisional application No. 61/987,287, filed on May 1, 2014.

(51) Int. Cl.
*G10L 19/018* (2013.01)
*G10L 19/02* (2013.01)

(52) U.S. Cl.
CPC ..... *G10L 19/018* (2013.01); *G10L 19/02* (2013.01)

(58) Field of Classification Search
CPC ..... G10L 19/018; G10L 19/02
USPC ..... 704/205
See application file for complete search history.

(56) References Cited

U.S. PATENT DOCUMENTS 5,388,181 A * 2/1995 Anderson ..... G10L 19/0204 704/200.1
6,633,653 B1 * 10/2003 Hobson ..... G06T 1/0042 382/100
7,505,514 B2 * 3/2009 Ahn ..... H04H 40/18 375/233
9,813,278 B1 * 11/2017 Meslelh ..... H04L 27/34
(Continued)

OTHER PUBLICATIONS

Arnold et al., "A Phase-Based Audio Watermarking System Robust to Acoustic Path Propagation," IEEE Transactions on Information Forensics and Security, vol. 9, No. 3, Mar. 2014, pp. 411-425
(Continued)

*Primary Examiner* — Edwin S Leland, III
(74) *Attorney, Agent, or Firm* — Fish & Richardson P.C.

(57) ABSTRACT

An audio watermarking system conveys information using an audio channel by modulating an audio signal to produce a modulated signal by embedding additional information into the audio signal. Modulating the audio signal includes segmenting the audio signal into overlapping time segments using a non-rectangular analysis window function produce a windowed audio signal, processing the windowed audio signal for a time segment to produce frequency coefficients representing the windowed time segment and having phase values and magnitude values, selecting one or more of the frequency coefficients, modifying phase values of the selected frequency coefficients using the additional information to map the phase values onto a known phase constellation, and processing the frequency coefficients including the modified phase values to produce the modulated signal.

8 Claims, 13 Drawing Sheets

(56) References Cited

U.S. PATENT DOCUMENTS

| | | | | |
|---|---|---|---|---|
| 2005/0212930 | A1* | 9/2005 | Sim | G06T 1/0028 348/231.4 |
| 2007/0014428 | A1* | 1/2007 | Kountchev | G06T 1/0028 382/100 |
| 2008/0027729 | A1* | 1/2008 | Herre | H04H 20/31 704/273 |
| 2013/0218314 | A1* | 8/2013 | Wabnik | G10L 19/018 700/94 |
| 2014/0142958 | A1* | 5/2014 | Sharma | G10L 19/018 704/500 |
| 2015/0340045 | A1* | 11/2015 | Hardwick | G10L 19/018 704/205 |

OTHER PUBLICATIONS

Chen, et al., "Quantization Index Modulation: A Class of Provably Good Methods for Digital Watermarking and Information Embedding," 2001 IEEE Transactions on Theory, vol. 47, Issue 4, pp. 1423-1443.

Dong et al., "Data Hiding via Phase Manipulation of Audio Signals," 2004 IEEE International Conference on Acoustics, Speech, and Signal Processing, vol. 5, 2004, pp. 377-380.

Gang et al., "MP3 Resistant Oblivious Steganography," 2001 IEEE International Conference on Acoustics, Speech, and Signal Processing, vol. 3, pp. 1365-1368.

PCT International Search Report for International Application No. PCT/US16/13639 filed Jan. 15, 2016 dated Jul. 12, 2016.

* cited by examiner

AUDIO WATERMARKING VIA PHASE MODIFICATION

CROSS-REFERENCE TO RELATED APPLICATIONS

This application is a divisional of U.S. application Ser. No. 14/702,536, filed May 1, 2015, now allowed, and titled "Audio Watermarking via Phase Modification," which claims priority to U.S. Provisional Application No. 61/987,287, filed May 1, 2014, and titled "Watermarking Using an Audio Channel," and U.S. Provisional Application No. 62/103,885, filed Jan. 15, 2015, and titled "Audio Watermarking via Phase Modification," all of which are incorporated by reference.

TECHNICAL FIELD

This disclosure relates to using watermarking to convey information on an audio channel.

BACKGROUND

"Watermarking" involves the encoding and decoding of information (i.e., data bits) within an analog or digital signal, such as an audio signal containing speech, music, or other auditory stimuli. A watermark encoder or modulator accepts an audio signal and a stream of information bits as input and modifies the audio signal in a manner that embeds the information into the signal while leaving the original audio content intact. The watermark decoder or demodulator accepts an audio signal containing embedded information as input (i.e., an encoded signal), and extracts the stream of information bits from the audio signal.

Watermarking has been studied extensively. Many methods exist for encoding (i.e., embedding) digital data into an audio, video or other type to signal, and generally each encoding method has a corresponding decoding method to extract the digital data from the encoded signal. Most watermarking methods can be used with different types of signals, such as audio, images, and video, for example. However, many watermarking methods target a specific signal type so as to take advantage of certain limits in human perception, and, in effect, hide the data so that a human observer cannot see or hear the data. Regardless of the signal type, the function of the watermark encoder is to embed the information bits into the input signal such that they can be reliability decoded while minimizing the perceptibility of the changes made to the input signal as part of the encoding process. Similarly, the function of the watermark decoder is to reliably extract the information bits from the watermarked signal. In the case of the decoder, performance is based on the accuracy of the extracted data compared with the data embedded by the encoder and is usually measured in terms of bit error rate (BER), packet loss, and synchronization delay. In many practical applications, the watermarked signal may suffer from noise and other forms of distortion before it reaches the decoder, which may reduce the ability of the decoder to reliably extract the data. For audio signals, the watermark decoder must be robust to distortions introduced by compression techniques, such as MP3, AAC, and AC3, which are often encountered in broadcast and storage applications. Some watermark decoders require both the watermarked signal and the original signal in order to extract the embedded data, while others, which may be referred to as blind decoding systems, do not require the original signal to extract the data.

One common method for watermarking is related to the field of spread spectrum communications. In this approach a pseudo-random or other known sequence is modulated by the encoder with the data, and the result is added to the original signal. The decoder correlates the same modulating sequence with the watermarked signal (i.e., using matched filtering) and extracts the data from the result, with the information bits typically being contained in the sign (i.e., +/−) of the correlation. This approach is conceptually simple and can be applied to almost any signal type. However, it suffers from several limitations, one of which is that the modulating sequence is typically perceived as noise when added to the original signal, which means that the level of the modulating signal must be kept below the perceptible limit if the watermark is to remain undetected. However, if the level (which may be referred to as the marking level) is too low, then the cross correlation between the original signal and the modulating sequence (particularly when combined with other noise and distortion that are added during transmission or storage) can easily overwhelm the ability of the decoder to extract the embedded data. To balance these limitations, the marking level is often kept low and the modulating sequence is made very long, resulting in a very low bit rate.

Another known watermarking method adds delayed and modulated versions of the original signal to embed the data. This effectively results in small echoes being added to the signal. The decoder calculates the autocorrelation of the signal for the same delay value(s) used by the encoder and extracts the data from the result, with the information bits being contained in the sign (i.e., +/−) of the autocorrelation. For audio signals, small echoes can be difficult to perceive and hence this technique can embed data without significantly altering the perceptual content of the original signal. However, by using echoes, the embedded data is contained in the fine structure of short time spectral magnitude and this structure can be altered significantly when the audio is passed through low bit rate compression systems such as AAC at 32 kbps. In order to overcome this limitation, larger echoes must be used, which may cause perceptible distortion of the audio.

Other watermarking systems have attempted to embed information bits by directly modifying the signal spectra. In one technique, which is described in U.S. Pat. No. 6,621,881, an audio signal is segmented and transformed into the frequency domain and, for each segment, one or two reference frequencies are selected within a preferred frequency band of 4.8 to 6.0 kHz. The spectral amplitude at each reference frequency is modified to make the amplitude a local minima or maxima depending on the data to be embedded. In a related variation, which is also described in U.S. Pat. No. 6,621,881, the relative phase angle between the two reference frequencies is modified such that the two frequency components are either in-phase (0 degrees phase difference) or out-of-phase (180 degrees phase difference) depending on the data. In either case, only a small number of frequency components are used to embed the data, which limits the amount of information that can be conveyed without causing audible degradation to the signal.

Another phase-based watermarking system, which is described in "A Phase-Based Audio Watermarking System Robust to Acoustic Path Propagation" by Arnold et. al., modifies the phase over a broad range of frequencies (0.5-11 kHz) based on a set of reference phases computed from a pseudo-random sequence that depends on the data to be embedded. As large modifications to the phase can create significant audio degradation, limits are employed that reduce the degradation but also significantly lower the amount of data that can be embedded to around 3 bps.

Many watermarking systems can be improved, in a rate-distortion sense, by using the techniques described in "Quantization Index Modulation: A Class of Provably Good Methods for Digital Watermarking and Information Embedding" by Chen and Wornell. In this approach, a multi-level constellation of allowed quantization values are assigned to represent the signal parameter (e.g., time sample, spectral magnitude, and phase) into which the data is to be embedded. These quantization values are then subdivided into two or more subsets, each of which represents a particular value of the data. In the case of binary data, two subsets are used. For each data bit, the encoder selects the best quantization value (i.e., the value closest to the original value of the parameter) from the appropriate subset and modifies the original value of the parameter to be equal to the selected value. The decoder extracts the data by measuring the same parameter in the received signal and determining which subset contains the quantization value that is closest to the measured value. One advantage of this approach is that rate and distortion can be traded off by changing the size of the constellation (i.e., the number of allowed quantization values). However, this approach must be applied to an appropriate signal parameter that can carry a high rate of information while remaining imperceptible. In one method, which is described in "MP3 Resistant Oblivious Steganography" by Gang et. al., Quantization Index Modulation (QIM) is used to encode data within the spectral phase parameters.

SUMMARY

An audio watermarking system allows information to be conveyed to a viewing device over an audio channel. The watermarking system includes a modulator/encoder that modifies the audio signal in order to embed information and a demodulator/decoder that detects the audio signal modifications to extract the information. Since this generally is not an error free process, a channel encoder and decoder are included to add redundant error correction data (FEC) to reduce the information error rate to acceptable levels.

In one general aspect, conveying information using an audio channel includes modulating an audio signal to produce a modulated signal by embedding additional information into the audio signal. Modulating the audio signal includes segmenting the audio signal into overlapping time segments using a non-rectangular analysis window function produce a windowed audio signal, processing the windowed audio signal for a time segment to produce frequency coefficients representing the windowed time segment and having phase values and magnitude values, selecting one or more of the frequency coefficients, modifying phase values of the selected frequency coefficients using the additional information to map the phase values onto a known phase constellation, and processing the frequency coefficients including the modified phase values to produce the modulated signal.

Implementations may include one or more of the following features. For example, the additional information may be encoded using error correction coding to produce encoded information that is used as the additional information to modify the phase values.

The phase constellation may include a quantizer offset to introduce an angular shift in the phase constellation. The size of the phase constellation may be varied to allow phase distortion to be reduced at frequencies where the phase distortion is more audible and to be increased at frequencies where the phase distortion is less audible.

Modifying the phase values of the selected frequency coefficients may include setting the phase values to allowed phase quantization values that are divided into multiple subsets, with each subset corresponding to a different value of a component of the additional information. Setting a phase value to an allowed phase quantization value may include setting the phase value to match a phase quantization value that (i) corresponds to a component of the additional information to be represented by the phase value and (ii) most closely matches the phase value. A component of the additional information may be represented by a group of phase values and setting the group of phase values to allowed phase quantization values may include setting the group of phase values to match a group of phase quantization values that (i) correspond to a component of the additional information to be represented by the group of phase values and (ii) most closely match the group of phase values. Modifying at least some of the phase values may include modifying only certain phase values corresponding to frequency coefficients between an upper and lower frequency bound, and may also include modifying only certain phase values corresponding to a subset of the time segments.

Modulating the audio signal may include using an iterative approach in which a first iteration includes computing a DFT on a windowed segment to form frequency coefficients represented using magnitude and phase values; modifying at least some of the phase values to embed information bits; inverse transforming modified frequency components including the modified phase values using an IDFT; applying a synthesis window to results of the inverse transforming; and combining windowed results from neighboring time segments to produce a first iteration of the modulated signal. One or more additional iterations of the computing, modifying, inverse transforming, and combining steps may be performed using the first iteration of the modulated signal instead of the audio signal.

In another general aspect, a watermark decoder that decodes watermark information that is embedded in a watermarked audio signal is configured to segment the watermarked audio signal into overlapping segments using a non-uniform analysis window function; transform a windowed segment to form frequency coefficients that are represented by magnitude and phase values; and extract an information bit of the watermark information from one or more of the phase values by determining whether the one or more of the phase values are closer to a first set of phase quantization values representing a first value for the information bit or a second set of phase quantization values representing a second value for the one or more information bits.

Implementations may include one or more of the following features. For example, the watermark decoder may be configured to extract an information bit of the watermark information from the phase values by combining phase values from multiple frequency coefficients into an aggregate phase value; and mapping the aggregate phase value to a received channel bit based on which of one or more subsets of phase quantization values includes a phase quantization value that is closest to the aggregate phase value. Combining phase values from multiple frequency coefficients into the aggregate phase value may include scaling each phase value in proportion to a phase constellation size corresponding to the frequency represented by the phase value, adding a phase offset to each scaled phase value to produce shifted phase values, and computing a weighted sum of the shifted phase values to form the aggregate phase value. The phase offset added to a scaled phase value to produce a shifted phase value may be determined for a particular segment according to a known time sequence.

The watermark decoder may be configured to synchronize to the watermarked audio signal by segmenting the watermarked audio signal for multiple different segmentation offsets, extracting one or more information bits of the watermark information for each of the multiple different segmentation offsets, and using the extracted information bits for each segmentation offset to determine the segmentation offset representing the best alignment with the watermarked audio signal.

The non-uniform analysis window used to produce the windowed segments in the watermark decoder may be matched to a window function used to embed the watermark information in the watermarked audio signal.

The watermark decoder may be configured to transform multiple segments and extract information bits of the watermark information from multiple transformed segments, where the transformed segments from which information bits are extracted do not overlap with one another.

The watermark decoder also may be configured to synchronize with the watermarked audio signal by repeatedly performing the segmenting, transforming and extracting at a first frequency to form synchronization information bits, assessing validity of the synchronization information bits, and determining that the watermark decoder is synchronized with the watermarked audio signal upon determining that the synchronization information bits are valid; and repeatedly perform the segmenting, transforming and extracting at a second frequency to form extraction information bits, wherein the first frequency is greater than the second frequency.

In another general aspect, information is conveyed using an audio channel through multiple iterations of modulating an audio signal to produce a modulated signal by embedding additional information into the audio signal. Modulating the audio signal includes segmenting the audio signal into time segments using an analysis window function to produce a windowed audio signal; processing the windowed audio signal for a time segment to produce frequency coefficients representing the windowed time segment and having phase values and magnitude values; selecting one or more of the frequency coefficients; modifying phase values of the selected frequency coefficients using the additional information; and processing the frequency coefficients including the modified phase values to produce an iteration of the modulated signal.

Implementations may include one or more of the following features. For example, the modulated signal produced by a prior iteration may be remodulated to reembed the additional information and produce a successive iteration of the modulated signal. Modifying the phase values of the selected frequency coefficients includes setting the phase values to allowed phase quantization values, where the allowed phase quantization values are divided into multiple subsets and each subset corresponds to a different value of a component of the additional information. Setting a phase value to an allowed phase quantization value may include setting the phase value to match a phase quantization value that (i) corresponds to a component of the additional information to be represented by the phase value and (ii) most closely matches the phase value.

In particular implementations, the encoder operates by using a Discrete Fourier Transform (DFT), which may be implemented as a Fast Fourier Transform (FFT), to convert the input signal into a Short-Time Fourier Transform (STFT) representation, and then the phase of selected frequency components from the STFT are modified to embed the information bits into the signal. Phase manipulation is used as a mechanism to embed the data since the human auditory system is relatively insensitive to phase, allowing an audio signal to carry data with little perceived change to the audio quality. In one implementation, an input signal sampled at 48 kHz is divided into overlapping segments using a window function, and a 1024 point FFT is computed for each windowed segment. The FFT coefficients are converted into a magnitude and phase representation, and one or more of the phase values are modified to embed the data by mapping the computed phase onto a known phase constellation. Varying the size of the phase constellation for different FFT coefficients allows the phase distortion to be reduced at frequencies where the phase distortion is more audible and increased at frequencies where the phase distortion is less audible, thereby improving performance. The encoder then computes an inverse FFT using the originally computed magnitudes and modified phase values and then combines the contribution from each overlapped segment using the same window function to produce an output signal containing the embedded data.

To improve performance, the encoder may use a power-normalized window function to divide the input signal into overlapping segments and to regenerate the output signal from the modified segments. Power-normalized window functions are commonly used with the Modified Discrete Cosine Transform (MDCT), as developed by Princen and Bradley and meet the condition $w^2[n]+w^2[n+N/2]=1$ where N is the window size (N=1024 in one implementation) and N/2 is the spacing between segments (i.e., there is a 50% overlap). A variety of power-normalized window functions may be used. For example, one implementation uses a Kaiser-Bessel Derived window function with $\alpha=6$ to provide good time-frequency localization.

One implementation employs a smooth window function which is overlapped (e.g., by 50% between neighboring segments) during spectral analysis and synthesis. Using such a window provides good time-frequency localization during analysis and prevents audible discontinuities at the segment boundaries during synthesis. However, the use of overlapping segments in the encoder results in more FFT coefficients than there are samples in the original signal. In other words, the frequency domain representation is over-constrained, and, if the FFT coefficients are modified (i.e., by changing the phase to embed data), then there is no output signal that the encoder can produce that will exactly match the modified FFT coefficients. As a result, the encoder uses an iterative process using simultaneous constraints on both the magnitude and phase in each iteration to generate an output signal that is a close, but not exact, match to the modified FFT coefficients. For example, one implementation uses ten iterations. This approach yields a higher performance watermark than traditional, non-iterative, STFT synthesis techniques such as weighted over-lap add (WOLA).

The decoder extracts the information bits embedded by the encoder by: (i) dividing the input signal into overlapping segments; (ii) computing an FFT of each segment; and (iii) converting the FFT to a magnitude/phase representation, typically using a set of processing steps similar to those that were used in the encoder. The phase of selected FFT coefficients is then compared against the appropriate phase constellation and the data is extracted based on which constellation point is closest to the measured phase. In order to extract the data reliably, the overlapping segments used in the decoder must be closely aligned (i.e. synchronized) to the overlapping segments used by the encoder. This ensures that the phase values measured within the decoder correspond to the modified phase values used by the encoder to embed the data.

In one implementation, a watermark encoder segments an audio signal into overlapping time segments using an analysis window function; computes a DFT (such as via an FFT) on the windowed segments to form frequency coefficients where such frequency coefficients are represented via magnitude and phase values; modifies at least some of the phase values to embed information bits by setting the phase to an allowed phase quantization value, where the phase quantization values are divided into multiple subsets and each subset corresponds to a different value of the information bit; and synthesizes a watermarked signal using the modified phase values. The phase values of selected frequency coefficients may be modified by setting the computed phase to the closest allowed phase quantization value. For binary data, a first subset of the phase quantization values is allowed when an information bit is a '0', and a second, mutually exclusive subset of the phase quantization values is allowed when an information bit is a '1'. For improved audio quality, the phase modification function may limit the amount of phase distortion for certain tone-like frequency components and vary the number of allowed phase quantization values in each subset for different frequency coefficients with more quantization values being allowed at frequency coefficients where human hearing is more sensitive to distortion and less quantization levels being allowed at frequency components where human hearing is less sensitive.

The phase values also may be modified in such a manner that each information bit affects multiple phase values. The information bits also may be passed through an error correcting code, such as a convolutional code or block code, to produce channel bits, each of which is then used to modify one or more of the phase values.

The watermark encoder may modify only certain phase values corresponding to frequency coefficients between an upper and lower frequency bound (e.g., $563<f<4406$ Hz) and only for a fraction of the time segments (typically every second time segment or every fourth time segment), leaving the phase values for other frequency coefficients and time segments unmodified. In an improved implementation, the phase modification is spread across multiple neighboring time segments for tone-like frequency components, and concentrated in a single time segment for non-tone-like frequency components.

The watermark encoder may synthesize a watermarked signal using an iterative method, where, in a first iteration, the magnitude and modified phase values for a segment are used to produce modified frequency coefficients that then are inverse transformed via an IDFT. A synthesis window is applied to the results of the IDFT, and the windowed result from neighboring segments is combined via the overlap-add method to produce the watermarked signal output of the first iteration. In optional subsequent iterations, the watermarked signal output of the prior iteration is re-segmented using the analysis window and converted back into frequency coefficients (represented as magnitude and phase) using an FFT, at which point at least some of the phase values are modified to embed information bits and the modified phase values are used to synthesize a watermarked signal output. The phase modification and signal synthesis steps generally are performed in the same manner as the first iteration. While a fixed number of iterations typically are performed, some implementations may perform a variable number of iterations and stop after some performance target is reached.

A watermark decoder may segment an audio signal into overlapping segments using an analysis window function; compute a DFT (or FFT) on the windowed segments to form frequency coefficients where such frequency coefficients are represented via magnitude and phase values; optionally add a frequency dependent phase offset and then extract information bits from the computed phase values, typically by determining whether the computed phase value is closer to a phase quantization value representing a '0' or a '1'. For binary data, the phase quantization values may be divided into a first subset of phase quantization values that represent a binary '0', and a mutually exclusive second subset of phase quantization values that represent a binary '1', and the extracted information bit may be set equal to a '0' if the closest phase quantization value in the phase constellation is in the first subset, and is set equal to a '1' if the closest phase quantization value is in the second subset. Furthermore the watermark decoder may use a different number of phase quantization values for different frequency coefficients, where more phase quantization values (i.e., a larger constellation) are used at frequencies where human hearing is more sensitive to distortion (i.e., low frequencies) and fewer phase quantization values (i.e., a smaller constellation) are used at frequencies where human hearing is less sensitive to distortion (i.e., high frequencies).

The watermark decoder may use multiple computed phase values corresponding to different frequency coefficients to extract information bits. The computed phase values from several frequency coefficients may be combined into an aggregate phase value that is then mapped to a received channel bit based on which subset contains the phase quantization value that is closest to the aggregate phase value. The received channel bit may form the extracted information bits, or optionally, the received channel bits may be error decoded, such as, for example, by using a Vitterbi decoder to decode a convolutional error correcting code, with the output of the error decoder forming the extracted information bits. The reliability or likelihood of the decoded information bit may be determined and used to estimate the validity of the data packet thereby permitting the watermark decoder to determine whether a valid watermark is contained within the audio signal.

The formation of the aggregate phase values in the watermark decoder may include scaling each computed phase value in proportion to the phase constellation size for that frequency, adding a time segment dependent phase offset, altering the sign based on a binary replication key, and computing a weighted sum of the resulting values to form the aggregate phase value, where all arithmetic is done modulo $2\pi$.

The decoder may be synchronized to a watermarked audio signal by having the decoder repeatedly segment a watermarked audio signal, extract information bits using multiple different segmentation offsets, and using the extracted information bits for each segmentation offset to determine the segmentation offset representing the best alignment with the watermarked audio signal. For example, in one implementation, using audio signals sampled at 48 kHz, subsample resolution in the segmentation offset is used to obtain improved performance and error correction decoding is used (by measuring the number of bit errors corrected and/or other distance measure between the received channel bits and the output of the error correction decoder) to determine which segmentation offset produces the best alignment with the watermarked audio signal.

The described techniques may be used to provide a fast synchronization method in which the decoder repeatedly segments a watermarked audio signal and computes aggregate phase values which are used to determine a small subset of candidate segmentation offsets. The aggregate phase offsets for each candidate are then further processed to extract the corresponding information bits which are then used to determine the candidate segmentation offset representing the best alignment with the watermarked audio signal. For example, aggregate phase values may be computed for two different time segment dependent phase offsets, corresponding to the two different (+/−1) possible values of a binary correlation sequence.

DESCRIPTION OF DRAWINGS

Like reference symbols in the various drawings indicate like elements.

DETAILED DESCRIPTION

Figure 1:
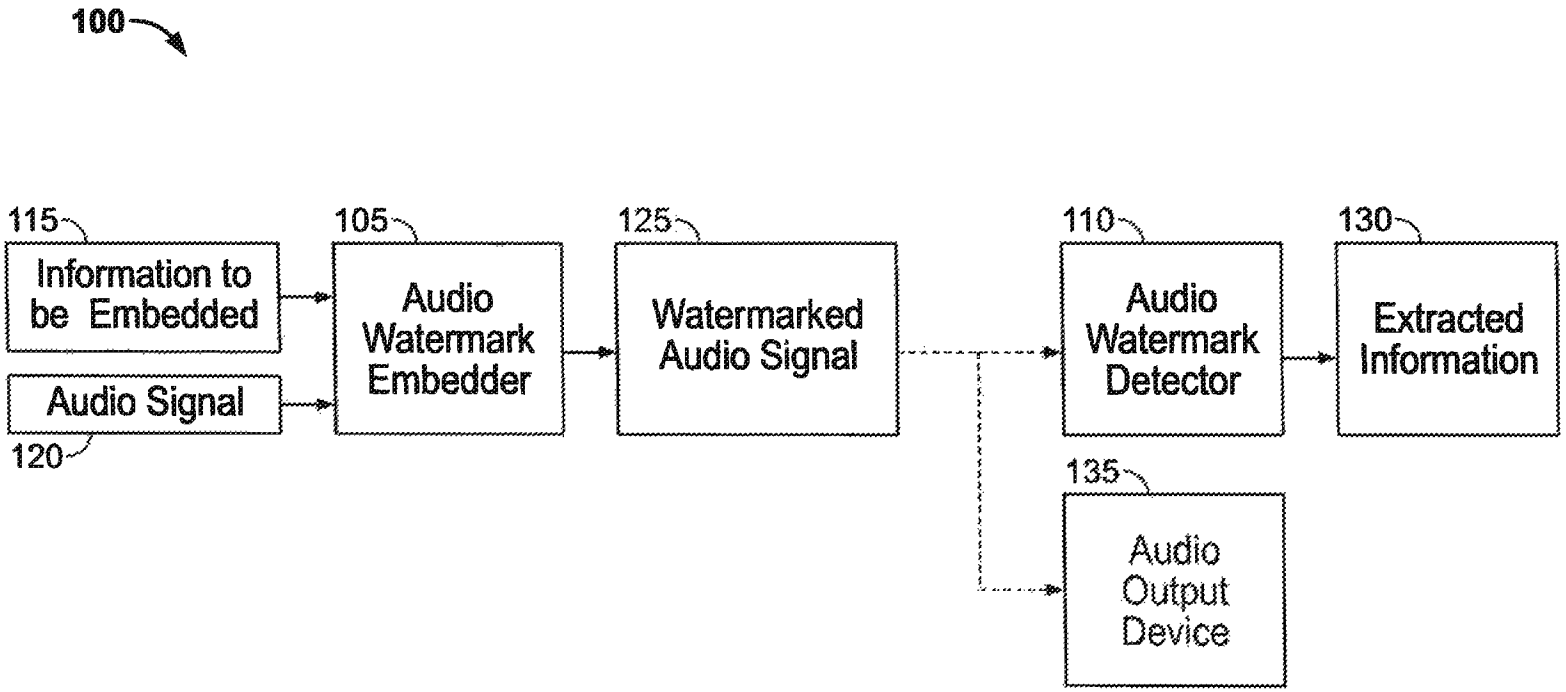
FIG. 1 is a block diagram of an audio watermarking system.

Referring to FIG. 1, an audio watermarking system 100 includes an audio watermark embedder 105 and an audio watermark detector 110. The audio watermark embedder 105 receives information 115 to be embedded and an audio signal 120, and produces a watermarked audio signal 125. Both the audio signal 120 and the watermarked audio signal may be analog audio signals that are compatible with low fidelity transmission systems.

The audio watermark detector 110 receives the watermarked audio signal 125 and extracts information 130 that matches the information 115. An audio output device 135, such as a speaker, also receives the watermarked audio signal 125 and produces sounds corresponding to the audio signal 120.

The audio watermarking system 100 may be employed in a wide variety of implementations. For example, the audio watermark embedder 105 may be included in a radio handset, with the information 115 being, for example, the location of the handset, the conditions (e.g., temperature) at that location, operating conditions (e.g., battery charge remaining) of the handset, identifying information (e.g., a name or a badge number) for the person using the handset, or speaker verification data that confirms the identity of the person speaking into the handset to produce the audio signal 120. In this implementation, the audio watermark detector 110 would be included in another handset and/or a base station.

In another implementation, the audio watermark embedder 105 is employed by a television or radio broadcaster to embed information 115, such as internet links, into a radio signal or the audio portion of a television signal, and the audio watermark detector 110 is employed by a radio or television that receives the signal, or by a device, such as a smart phone, that employs a microphone to receive the audio produced by the radio or television.

Figure 2:
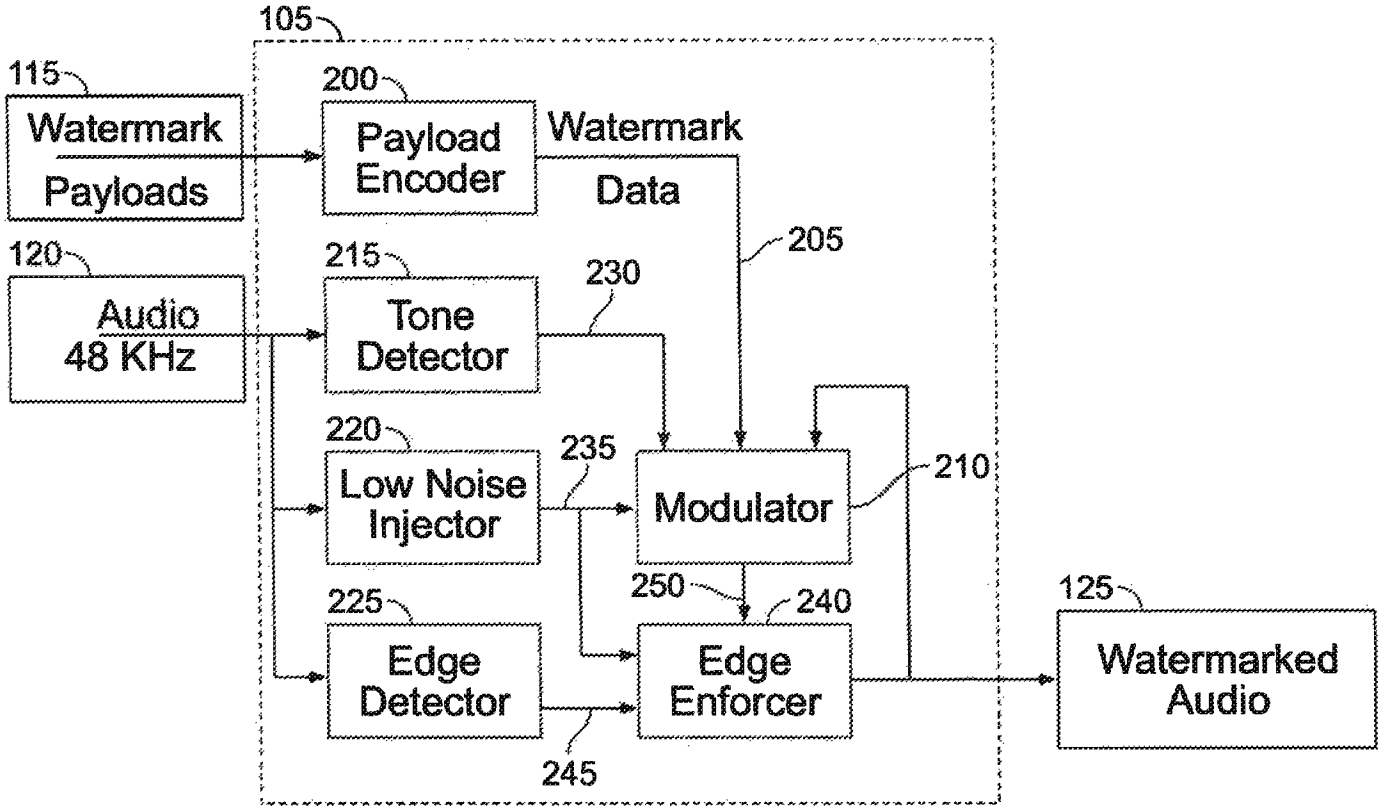
FIG. 2 is a block diagram of an audio watermark embedding system.

Referring to FIG. 2, in one implementation, the audio watermark embedder 105 includes a payload encoder 200 that encodes the information 115 to provide watermark data 205 that is provided to a modulator 210.

Figure 3:
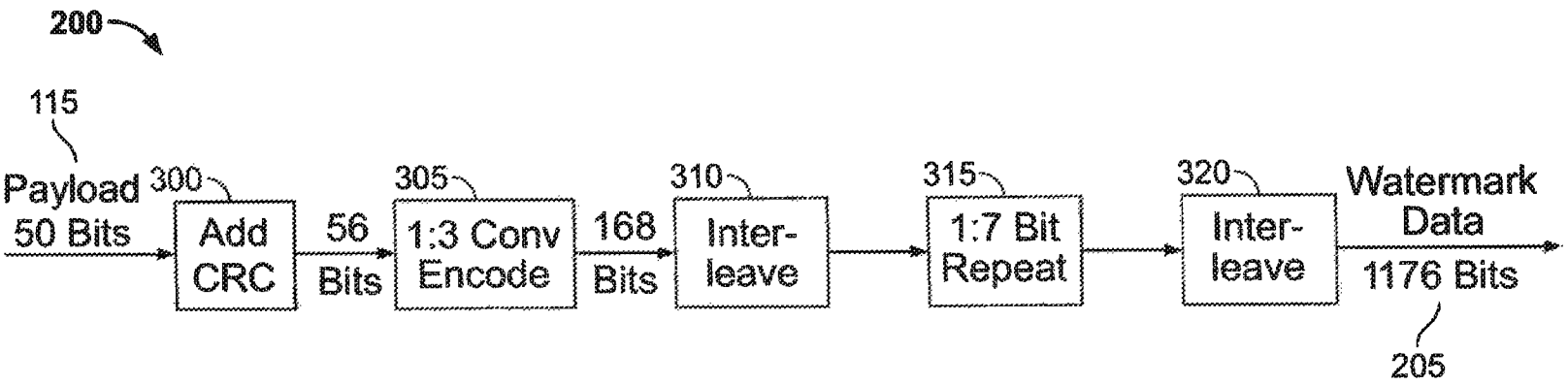
FIG. 3 is a block diagram of a data encoder.

Referring to FIG. 3, one implementation of the payload encoder 200 encodes 50 bits of information 115 to produce 1176 bits of watermark data 205. Initially, the payload encoder 200 divides the stream of source bits into packets of 50 bits. Each packet is first protected with a 6-bit cyclic redundancy check ("CRC") 300 with a generator polynomial to provide error detection, and then the resulting 56 bits are encoded with a rate=1/3 circular convolutional code to produce a 168 bit packet of channel data. While other error detection and correction codes can be used, the implementation uses a 6 bit CRC and a rate=1/3 convolutional code 305 formed with generator polynomials:

$$G_1(X)=1+X^2+X^3+X^5+X^6+X^7+X^8,$$

$$G_2(X)=1+X+X^3+X^4+X^7+X^8, \text{ and}$$

$$G_3(X)=1+X+X^2+X^5+X^8.$$

The 168 bits of channel data are then interleaved (310) into STFT phase values (which are generated as discussed below), where one implementation embeds 6 of the channel bits into the STFT computed from the audio signal at a particular sample time. Bit replication (315) is applied where each channel bit is repeated 7 times and then the resulting 42 bits are embedded (320) into the 42 phase values corresponding to FFT frequency coefficients [12, 14, 16, . . . 94] for a FFT length of 1024. Typically, the first of the six bits is repeated and embedded into FFT frequency coefficients [12, 24, 36, 48, 60, 72, 84], the second of the six bits is repeated and embedded into FFT frequency coefficients [14, 26, 38, 50, 62, 74, 86], and so on until all 6 bits are embedded in the STFT for that sample time. The 168 bit packet is embedded 6 bits per FFT in this way, resulting in the packet being spread over 28 different sample times. Using a FFT spacing of 2048 samples, this results in a packet length of 57344 samples or 1.19467 seconds at a 48 kHz sample rate. This results in a bit rate of 41.85 bps.

The audio watermark embedder also includes a tone detector 215, a low noise injector 220, and an edge detector 225 that receive the audio signal 120.

The tone detector 215 produces a tone detection signal 230 that is supplied to the modulator 210 as a control signal. In general, the phase modification employed by the audio watermark embedder 105 may be audible when the audio signal is a pure tone. The modulator 210 uses the tone detection signal 230 to turn off modulation when the audio signal is a pure tone so as to avoid audible distortion that might otherwise result.

The low noise injector 220 produces a modified audio signal 235 that is supplied to the modulator 210 and to an edge enforcer 240. The low noise injector adds a low volume noise signal to zero-value portions of the audio signal because data cannot be embedded in such zero-value portions.

The edge detector 225 detects transitions (i.e., edges) in the audio signal and produces an edge detection signal 245 that is supplied to the edge enforcer 240, which also receives a modulated audio signal 250 from the modulator 210, and uses the modulated audio signal 250, the modified audio signal 235, and the edge detection signal 245 to generate the watermarked audio signal 125. The edge enforcer modifies the window used to produce the watermarked audio signal in regions where transitions occur. In general, the edge enforcer uses a shorter window in such transition regions.

The modulator 210 uses the watermark data 205, the tone detection signal 230, the modified audio signal 235, and the watermarked audio signal 125 (which is provided through a feedback loop), to produce the modulated audio signal 250.

Figure 4:
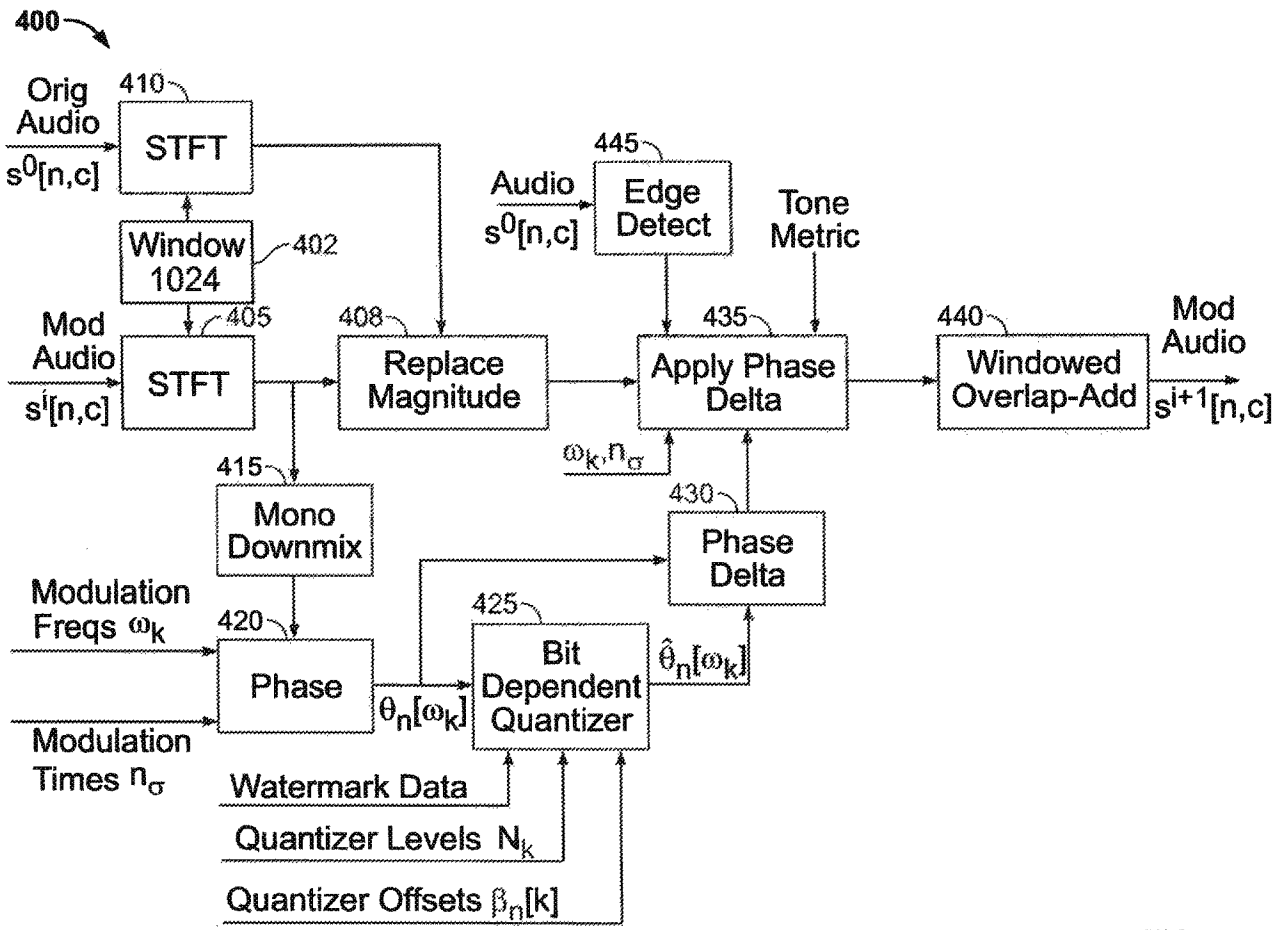
FIG. 4 is a block diagram of a data modulator.

FIG. 4 illustrates a watermark modulator 400 that serves as an example of the modulator 210. The watermark modulator 400 receives a sampled signal s[n, c], where n is a time index and c is a channel index. The sampled signal s[n, c] may be monaural (one channel), stereo (two channels), or 5.1 surround (6 channels). Exemplary parameters will be given for a sampling rate of 48 KHz. A window function (402) is applied to the sampled signal and a multichannel Short Time Fourier Transform ("SFFT") (405) is applied to the windowed signal. For the window function (420), an analysis window function w[n] may use a power normalized Kaiser-Bessel Derived window function with $\alpha$=6 to provide good time/frequency localization with an exemplary length of 1024 samples.

The watermark modulator performs an iterative approach in which the original audio ($s^o$[n, c]) is compared to the audio produced in an iteration i ($s^i$[n, c]) with the goal of refining the analysis until the modified audio closely matches the original audio. One implementation employs ten iterations.

The SFFT (405) processes the original and subsequent iterations of the sampled signal using an FFT with exemplary length of 1024 samples:

$$S_n[\omega_k, c] = \sum_m w[m]s[n+m, c]e^{-j\omega_k m}.$$

The STFT (405) need not be computed for every sample n to achieve perfect reconstruction. For example, with the exemplary window, perfect reconstruction may be achieved by computing the STFT every S samples, where S is half the window length. Thus, in the case of a window length of 1024 samples, the STFT (405) may be performed every 512 samples.

The multichannel STFT may be expressed as magnitude $\mu_n[\omega_k, c]$ and phase $\theta_n[\omega_k, c]$.

$$S_n[\omega_k, c] = \mu_n[\omega_k, c]e^{-j\theta_n[\omega_k, c]}$$

For each iteration, the magnitude components produced by the STFT (405) using $s^i$[n, c] are replaced (408) by the magnitude components produced by a STFT (410) resulting from $s^o$[n, c].

When the sampled signal contains more than one channel, a downmix weighting d[c] (415) may be used to produce a monaural STFT:

$$Z_n[\omega_k] = \sum_c d[c]S_n[\omega_k, c].$$

The monaural STFT may be expressed as magnitude and phase (420):

$$Z_n[\omega_k] = \mu_n[\omega_k]e^{-j\theta_n[\omega_k]}.$$

Target phase values may be determined from the measured phase and the desired channel bits using a bit dependent quantization function (425):

$$\hat{\theta}_n[\omega_k] = Q(\theta_n[\omega_k], b_n[k]).$$

Figure 5:
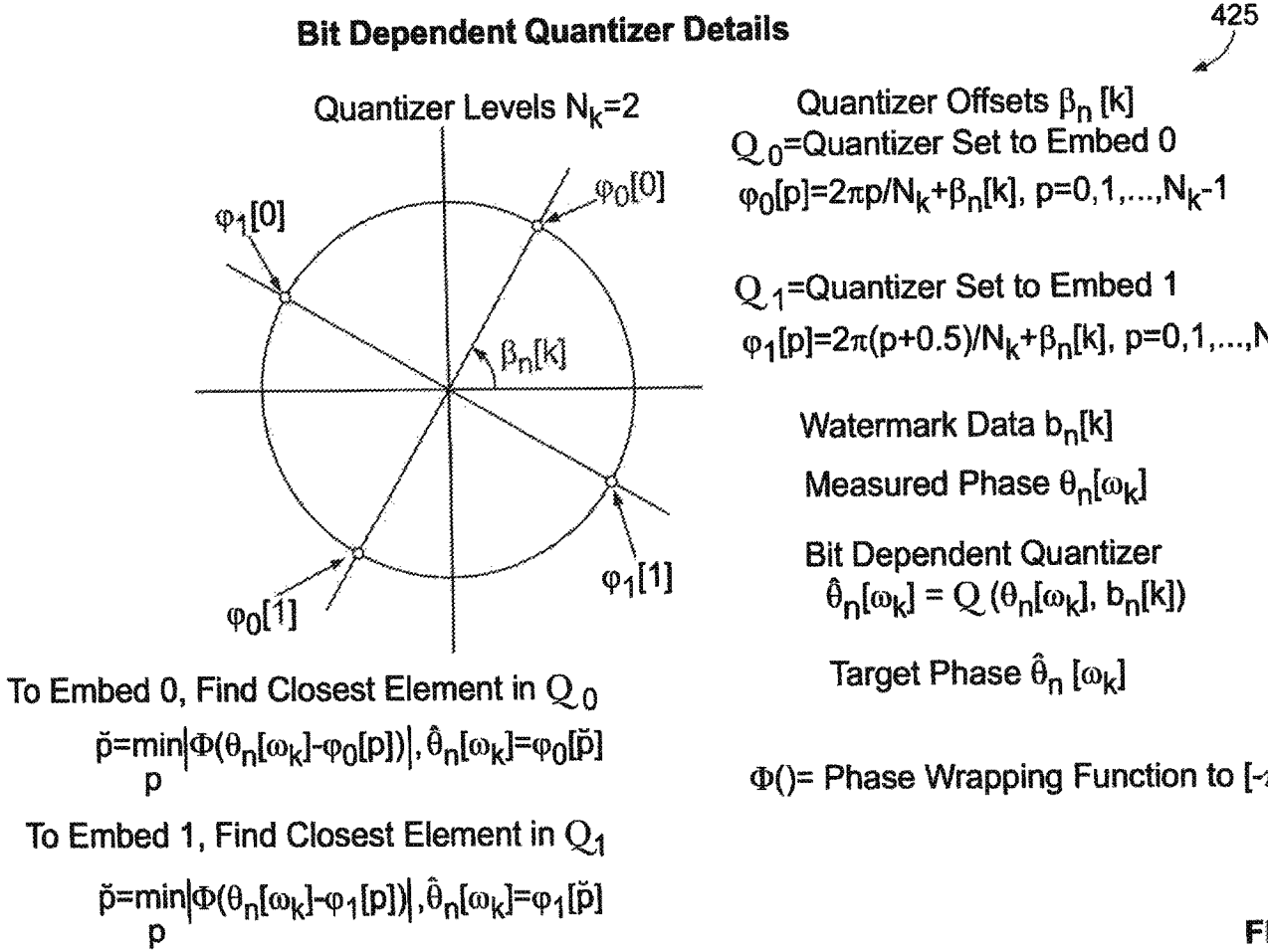
FIG. 5 is a diagram showing details of a bit dependent quantizer.

As shown in FIG. 4, the output of the bit dependent quantization function (425) is compared to the phase (420) of the monaural STFT to produce a phase delta (430) that is applied (435) to the results of the STFT (405) and the magnitude replacement (408) to produce an output supplied to a window overlap-add function (440) that produces the next iteration of the modified audio signal. When the phase delta (430) is produced, this is done in the context of the results of edge detection (445) and a tone metric to address issues that may occur if there is a sharp edge or a tone in the audio signal, as noted above, and discussed below with respect to FIG. 8. The bit dependent quantization function (425), shown in FIG. 5, is based on a defined phase constellation that includes a first set of quantized values for transmitting a 0 and a second set of quantized values for transmitting a 1. To transmit a 0, the closest value in the first set to the measured phase is selected as the target phase. To transmit a 1, the closest value in the second set to the measured phase is selected as the target phase. An exemplary system uses the set $\phi(2\pi p/N_k+\beta_n[k]$ to transmit a 0 where $N_k$ is the number of quantizer values in the set, p is an integer in the interval $[0,N_k-1]$, $\beta_n[k]$ is a quantizer offset, and $\phi(\theta)$ is a phase wrapping function to the interval $[-\pi,\pi]$. The set $\phi(2\pi(p+0.5)/N_k+\beta_n[k])$ is used to transmit a 1. The quantizer offsets $\beta_n[k]$ may be used for security purposes to make it difficult to find and decode the mark unless the quantizer offsets are known. These quantizer offsets produce an angular shift of the phase constellation used for the k'th frequency component as shown in FIG. 5. A second set of quantizer offsets may be designed to facilitate watermark layering. The second set of quantizer offsets also may be used to aid synchronization. For example, the time variation of the quantizer offsets may be designed based on a sequence with low autocorrelation sidelobes. Starting with a baseline set of quantizer offsets with no time variation, one bit of a low autocorrelation sidelobe sequence (LASS) is checked at each modulation time (i.e. for each windowed segment), and if a zero is encountered in the LASS, then $\pi/N_k$ is added to the baseline set of quantizer offsets for the current modulation time, and if a one is encountered in the LASS then the quantizer offsets are not changed from the baseline value. An exemplary system with 28 symbols per packet (i.e a 50 bit payload), uses the sequence [1000111100010001000100101101] for the LASS.

The phase modification produced by the bit dependent quantization function may be perceived as a frequency modulation since frequency is the derivative of phase with respect to time. The filter bank in the human auditory system has smaller bandwidths at lower frequencies, making it more sensitive to frequency changes at lower frequencies. Consequently, to minimize perceptual distortion, the number of quantizer values $N_k$ should increase at lower frequencies. An exemplary system uses $$N_k = \left\lfloor \frac{A}{\omega_k} + 0.5 \right\rfloor$$

where A is a parameter with exemplary value 1.1 which may be used to trade off robustness of the mark versus distortion, and $\omega_k$ is the normalized radian modulation frequency. A larger value for A produces a less robust mark with lower distortion. A smaller value for A produces a more robust mark with higher distortion.

Figure 6:
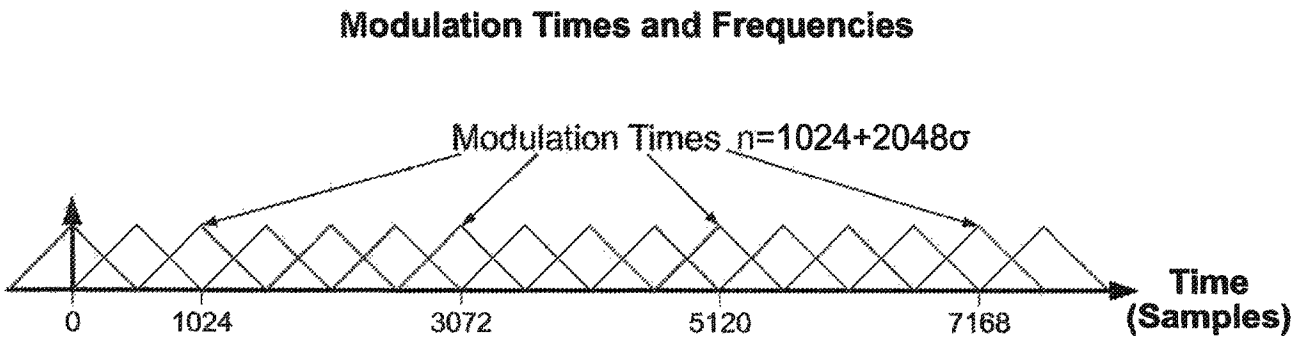
FIG. 6 illustrates modulation times.

A length 1024 FFT produces 513 frequency samples for each time interval for which it is computed (with sample 0 corresponding to DC, and sample 512 corresponding to 24 KHz). Referring to FIG. 6, the exemplary system computes FFTs every 512 time samples. Target phases may be defined for a subset of the computed FFT times termed the modulation times. An exemplary system defines target phases for FFT sample times n=1024+2048 σ where σ is the symbol number. Thus, in this example, target phases are defined for every fourth FFT, starting with the one at sample 1024.

Figure 7:
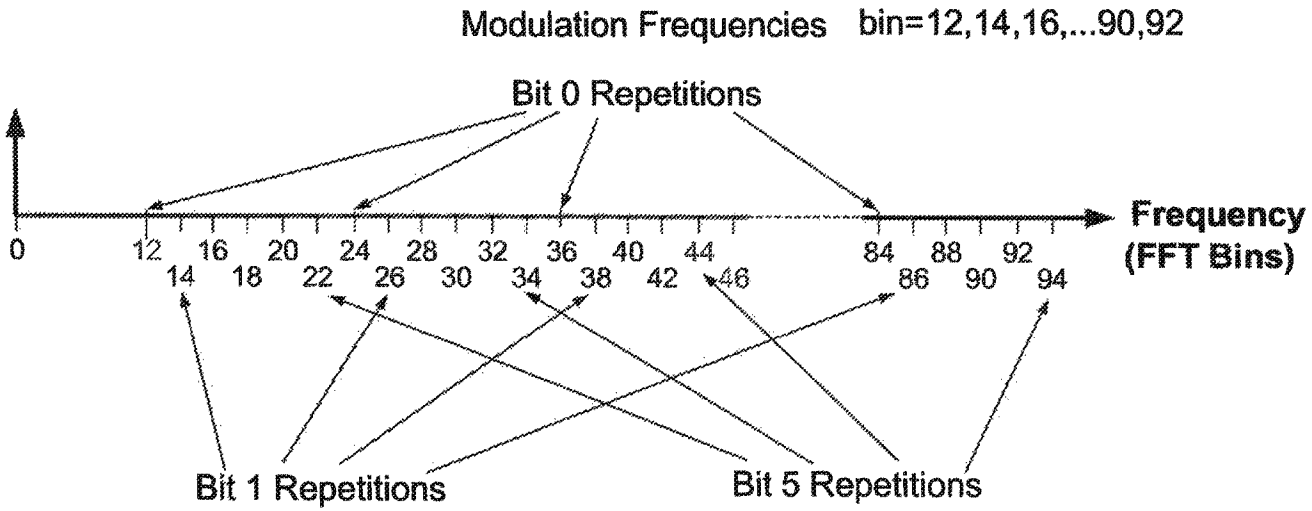
FIG. 7 illustrates modulation frequencies.

Referring to FIG. 7, target phases may be defined for a subset of the computed frequencies designated as the modulation frequencies. An exemplary system defines target phases for FFT frequency samples 12, 14, 16, . . . 92, 94 for a total of 42 target phases per modulation time.

The wrapped difference between target and measured phase may be defined for frequencies in the modulation frequency set and times in the modulation time set $\Phi(\hat{\theta}_n[\omega_k]-\theta_n[\omega_k])$.

A mark strength $\alpha_n[\omega_k]$ in the interval [0,1] may be used to produce a mark strength adjusted multichannel target phase:

$$\phi_n[\omega_k,c]=\Phi(\theta_n[\omega_k,c]+\alpha_n[\omega_k]\Phi(\hat{\theta}_n[\omega_k]-\theta_n[\omega_k])).$$

Figure 8:
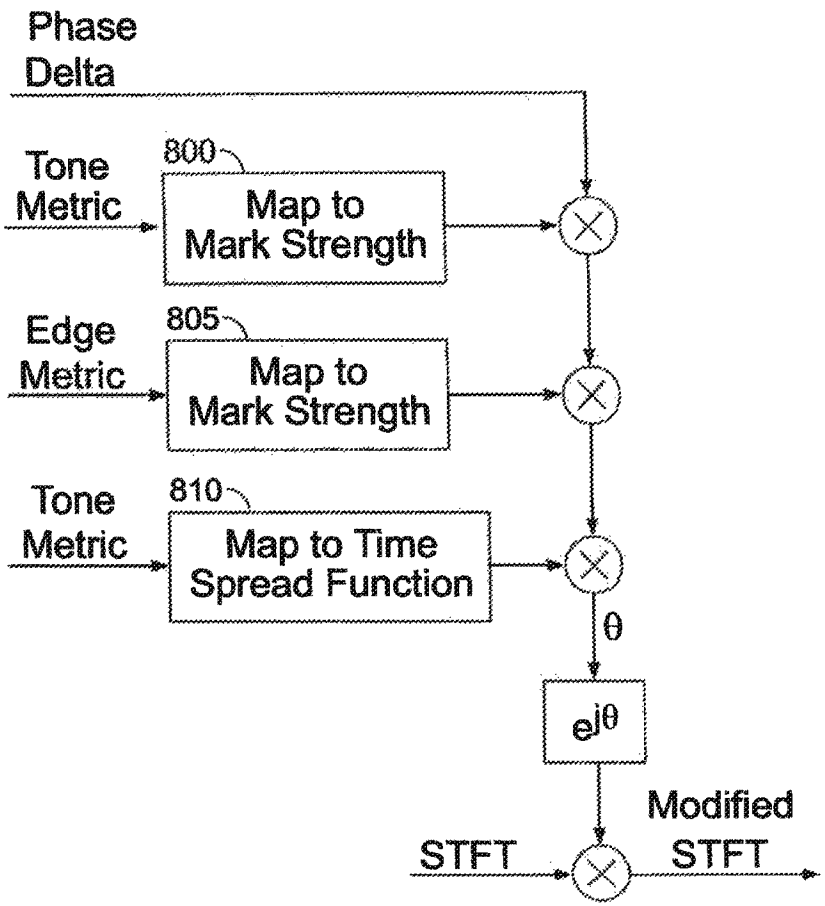
FIG. 8 is a block diagram showing factors impacting a phase delta determination.

For certain signal characteristics, the modulation process is more likely to produce perceptible distortion. These characteristics may be detected and the mark strength may be reduced from its initial value of 1 to maintain marked signal quality. Referring to FIG. 8, these factors may be accounted for when applying the phase delta (435) as discussed with respect to FIG. 8. In particular, the phase delta from the bit dependent quantizer (425) may be modified to adjust the mark strength in response to a tone metric (800) or in response to an edge (805), or to apply a time spreading function (810) in response to a tone metric. As discussed in more detail below, this use of mark strength adjustments and the time spreading function may further improve quality when tone-like audio signals are detected.

For example, the adjusting of the mark strength in response to a tone metric (800) may be used when there is a tone with high energy to surrounding energy (in frequency) and slowly changing frequency, as the phase modulation of such a tone may sometimes be perceived as a frequency modulation of the tone. Such tones may be detected by measuring the sum of magnitudes near the tone compared to the sum of magnitudes of a larger interval of frequencies containing the tone. This tone to total magnitude ratio (TTR) varies between 0 and 1 with values near 1 indicating a strong tone. An exemplary system compares the TTR to a threshold of 0.9, and, when the TTR is above the threshold, reduces the mark strength by 15(TTR-0.9) with a minimum mark strength of 0. In computing TTR, a longer TTR analysis window is advantageous for increased frequency resolution. An exemplary system uses a length 4096 TTR analysis window with a length 4096 FFT. The TTR analysis window is centered on the analysis window at the modulation time. For each modulation frequency, 5 TTR FFT magnitude samples are summed over an interval centered on the modulation frequency and divided by the sum of 9 TTR FFT magnitudes centered on the modulation frequency. This is repeated for intervals centered at the modulation frequency minus one, two, and three TTR FFT samples and well as plus one, two, and three TTR FFT samples. The maximum TTR over these seven different center samples is selected as the TTR estimate for determining mark strength reduction.

The adjusting of the mark strength in response to an edge (805) may be used when a positive time step in magnitude occurs in the signal. In such a situation, the modulation process may allow a perceptible amount of energy from the high magnitude region to bleed into the low magnitude region. At a particular modulation frequency, the magnitude in a time region after the current modulation time may be compared to the sum of magnitudes in regions before and after the current modulation time to form an After to Total Ratio (ATR). The ATR varies between 0 and 1 with values near 1 indicating a strong positive edge. An exemplary system has an initial ATR mark strength of 1.0, compares the ATR to a threshold of 0.9, and, when the ATR is above the threshold, reduces the ATR mark strength by 15(ATR-0.9) with a minimum ATR mark strength of 0. Then, the mark strength is updated by multiplying the mark strength by the ATR mark strength. In computing ATR, a shorter ATR analysis window is advantageous for increased time resolution.

An exemplary system uses a length 512 TTR analysis window with a length 1024 FFT. The before ATR analysis window covers the first 512 samples of the length 1024 analysis window, and the after ATR analysis window covers the last 512 samples of the analysis window. For each modulation frequency, an initial ATR is computed by after magnitude by the sum of before and after magnitudes. The ATR at a modulation frequency is set to the initial ATR at that frequency. If the initial ATR at the two adjacent modulation frequencies are both larger, the ATR is replaced by the average of the two adjacent ATRs. This ATR is then used to compute the ATR mark strength.

The goal is to produce a signal $s^i[n,c]$ with STFT phase close to the mark strength adjusted multichannel target phase at the modulation frequencies and times and STFT magnitude close to the original STFT magnitude. As noted above, this may be done in an iterative manner where i is the iteration number. A difference between the multichannel target phase and the multichannel phase at the current iteration may be defined:

$$\delta_n^i[\omega_k,c]=\Phi(\phi_n[\omega_k,c]-\theta_n^i[\omega_k,c,c]).$$

A time spreading function (810) may be applied when the TTR is high, as it is beneficial to spread this difference over FFT sample times adjacent to the modulation time. This spreading reduces the perceived frequency modulation of tonal components of the signal. Exemplary spreading functions $v_n[k,m]$ are listed in the following table. In this table, an index of 0 corresponds to the modulation time, an index of 1 corresponds to the next FFT sample time, and an index of −1 corresponds to the previous sample time. The TTR column lists the thresholds where the phase spreading function is applied. So, for example, for 0.90<TTR<=0.92, the phase spreading function [0.050 0.389 0.812 1.000 0.812 0.389 0.050] is applied.

| TTR | Index = −3 | Index = −2 | Index = −1 | Index = 0 | Index = 1 | Index = 2 | Index = 3 |
|---|---|---|---|---|---|---|---|
| 0.70 | 0.000 | 0.000 | 0.000 | 1.000 | 0.000 | 0.000 | 0.000 |
| 0.80 | 0.000 | 0.000 | 0.250 | 1.000 | 0.250 | 0.000 | 0.000 |
| 0.84 | 0.000 | 0.000 | 0.500 | 1.000 | 0.500 | 0.000 | 0.000 |
| 0.87 | 0.000 | 0.095 | 0.655 | 1.000 | 0.655 | 0.095 | 0.000 |
| 0.90 | 0.000 | 0.250 | 0.750 | 1.000 | 0.750 | 0.250 | 0.000 |
| 0.92 | 0.050 | 0.389 | 0.812 | 1.000 | 0.812 | 0.389 | 0.050 |
| 1.00 | 0.146 | 0.500 | 0.854 | 1.000 | 0.854 | 0.500 | 0.146 |

The initial modified multichannel STFT is formed:

$$X_n^0[\omega_k, c] = \mu_n[\omega_k, c] e^{-j\rho_n^0[\omega_k, c]},$$

where the initial phase $\rho_n^0[\omega_k, c]$ is set to the measured phase $\theta_n[\omega_k, c]$ plus the phase spread difference $$\rho_n^0[\omega_k, c] = \theta_n[\omega_k, c] + \sum_m v_n[k, n-m]\delta_n^0[\omega_k, c].$$

An estimated signal with multichannel STFT close to this desired value is computed using a windowed overlap-add method $$s^i[n, c] = \sum_m w[n-m] x_m^i[n-m, c],$$

where $x_n^i[m, c]$ is the inverse DFT of $X_n^i[\omega_k, c]$.

The multichannel STFT of $s^i[n, c]$ may be computed $$S_n^i[\omega_k, c] = \sum_m w[m] s^i[n+m, c] e^{-j\omega_k m},$$

and then the monaural STFT $$Z_n^i[\omega_k] = \sum_c d[c] S_n^i[\omega_k, c] = \mu_n^i[\omega_k] e^{-j\theta_n^i[\omega_s]}.$$

The next modified multichannel STFT then is formed:

$$X_n^i[\omega_k, c] = \mu_n[\omega_k, c] e^{-j\rho_n^i[\omega_k, c]},$$

where $$\rho_n^i[\omega_k, c] = \theta_n[\omega_k, c] + \sum_m v_n[k, n-m]\delta_n^i[\omega_k, c].$$

Figure 9:
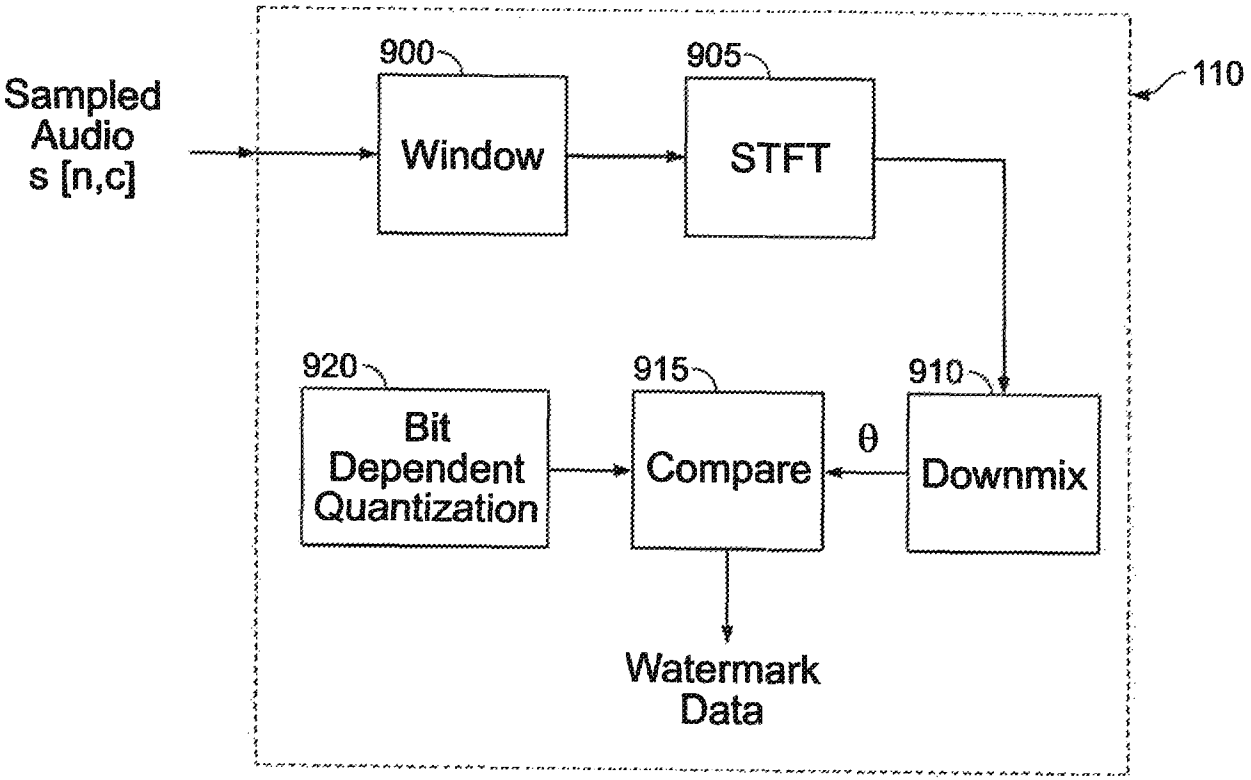
FIG. 9 is a block diagram of an audio watermark detector.

Referring to FIG. 9, an audio watermark detector 110, which may also be referred to as a decoder or a demodulator, receives a sampled signal s[n,c] where n is a time index and c is a channel index. The sampled signal s[n,c] may be monaural (one channel), stereo (two channels), or 5.1 surround (6 channels). Exemplary parameters will be given for a sampling rate of 48 KHz.

A window function (900) and a STFT (905) are applied to the sampled signal. As the window function (900), an analysis window function w[n] may use a power normalized Kaiser-Bessel Derived window function with $\alpha$=6 to provide good time/frequency localization with an exemplary length of 1024 samples. The multichannel STFT may be computed using an FFT with exemplary length of 1024 samples $$S_n[\omega_k, c] = \sum_m w[m] s[n+m, c] e^{-j\omega_k m}.$$

When the sampled signal contains more than one channel, a downmix weighting d[c] (910) may be used to produce a monaural STFT:

$$Z_n[\omega_k] = \sum_c d[c] S_n[\omega_k, c].$$

The monaural STFT may be expressed as magnitude and phase $$Z_n[\omega_k] = \mu_n[\omega_k] e^{-j\theta_n[\omega_k]}.$$

The embedded watermark bits may be recovered by comparing (915) the measured phase $\theta_n[\omega_k]$ to the output of the bit dependent quantization function $Q(\theta_n[\omega_k], d_n[k])$ (920) for each possible bit value $d_n[k]$. If the quantized phase for a 0 bit $Q(\theta_n[\omega_k], 0)$ is closer to the measured phase $\theta_n[w_k]$ than the quantized phase for a 1 bit $Q(\theta_n[\omega_k]1)$, then the decoded bit $d_n[k]$ for modulation frequency $\omega_k$ and modulation time n is set to 0. Otherwise, the decoded bit is set to 1.

Soft demodulated bits $\hat{d}_n[k]$ (with values in the interval [−1,1]) may be computed as $$\hat{d}_n[k] = 2\frac{\theta_n[\omega_k] - Q(\theta_n[\omega_k], 0)}{Q(\theta_n[\omega_k], 1) - Q(\theta_n[\omega_k], 0)} - 1.$$

Figure 10:
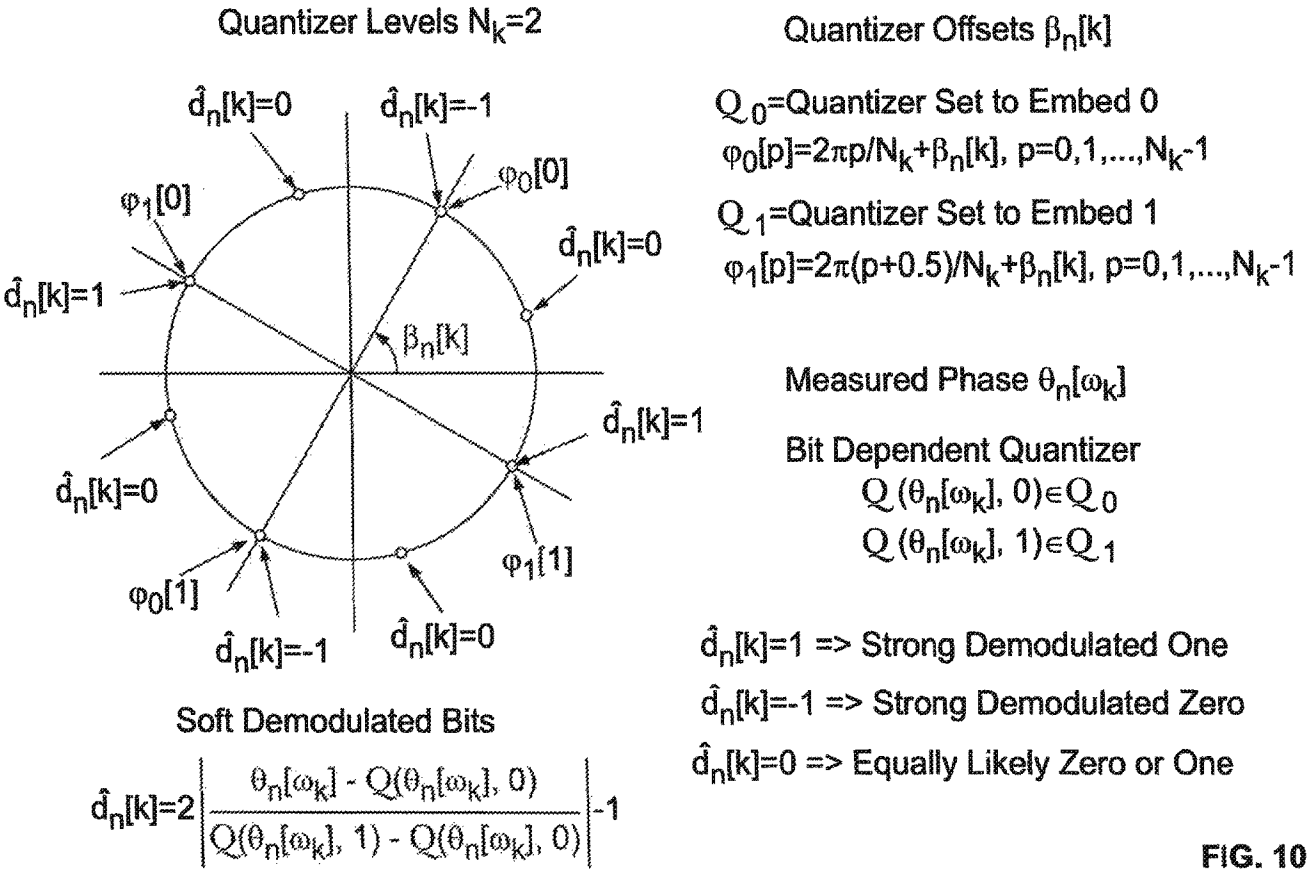
FIG. 10 is a diagram showing details of a bit dependent quantizer.

The relationship between the soft demodulated bits, the quantizer offset and measured phase is depicted in FIG. 10. The effect of the quantizer offset $\beta_n[k]$ is to add an angular shift to the phase constellation used by the demodulator.

It is often advantageous to compute weights $\gamma_n(k)$ for the soft demodulated bits $\hat{d}_n(k)$ to improve the error correction performance of the channel decoder. For example, higher bit error rates are expected in regions of low amplitude due to lower signal-to-noise ratios in these regions. Weights which depend on magnitude, such as $$\gamma_n[k] = \mu_n[\omega_k],$$

may be used to improve performance in these regions. In addition, error statistics for bits modulated at particular frequencies may be estimated and used to modify the weights so that frequencies with lower estimated bit error rates have higher weights than frequencies with higher estimated bit error rates. Error statistics as a function of audio signal characteristics may also be estimated and used to modify the weights. For example, the modulator may be used to estimate the demodulation error for a particular segment of the audio signal and frequency and the weights may be decreased when the estimated demodulation error is large.

A desired property of audio watermarks is robustness when coded with a low bit rate audio coder. Audio coders typically use a perceptual model of the human auditory system to minimize perceived coding distortion. The perceptual model often determines a masking level based on the time/frequency energy distribution. An exemplary system uses a similar perceptual model to estimate a masking level. The weights $\gamma_n(k)$ are then set to the magnitude-to-mask ratio at each modulation frequency and time.

Error Correction/Detection

A watermarked audio signal is often subject to various forms of distortion including additive noise, low bit rate compression, and filtering, and these can all impact the ability of the demodulator to reliably extract the information bits from the watermarked audio signal. In order to improve performance and synchronization, an implementation uses a combination of features including bit repetition, error correction coding, and error detection.

The modulator receives a stream of information source bits and applies error correction coding and error detection coding to create a higher rate stream of channel bits. For example, as discussed above with respect to FIG. 3, one implementation divides the stream of source bits into packets of 50 bits. Each packet is first protected with a 6 bit CRC with a generator polynomial $G(X)=1+X+X^6$ to provide error detection, and then the resulting 56 bits are encoded with a rate=1/3 circular convolutional code to produce a 168 bit packet of channel data. While other error detection and correction codes can be used, the implementation uses a 6 bit CRC and a rate=1/3 convolutional code formed with generator polynomials:

$$G_1(X)=1+X^2+X^3+X^5+X^6+X^7+X^8,$$

$$G_2(X)=1+X+X^3+X^4+X^7+X^8, \text{ and}$$

$$G_3(X)=1+X+X^2+X^5+X^8$$

The 168 bits of channel data are then embedded by the modulator into the STFT phase values, where one implementation embeds 6 of the channel bits into the STFT computed from the audio signal at a particular sample time. Bit replication is applied where each channel bit is repeated 7 times and then the resulting 42 bits are embedded into the 42 phase values corresponding to FFT frequency coefficients [12, 14, 16, . . . 94] for an FFT length of 1024. Typically, the first of the six bits is repeated and embedded into FFT frequency coefficients [12, 24, 36, 48, 60, 72, 84], the second of the six bits is repeated and embedded into FFT frequency coefficients [14, 26, 38, 50, 62, 74, 86], and so on until all 6 bits are embedded in the STFT for that sample time. The 168 bit packet is embedded 6 bits per FFT in this way, resulting in the packet being spread over 28 different sample times.

In one implementation, which may be applicable to broadcast television, the 50 bit packet may be divided as shown in Table 1. This packet includes the following information:

1) a Channel ID (16 bits) which indicates the channel being viewed and which may be useful for recognizing a channel change;
2) a binary Type field (1 bit) which indicates the length of the Media ID and Timecode fields;
3) a Media ID (24 bits or 20 bits) which provides unique identifier of the content being viewed;
4) a Timecode (7 bits or 11 bits) which provides temporal location within the content being viewed, with a range of 2.58 or 40.76 minutes;
5) a trigger (1 bit) which maybe be used as a time-sensitive trigger to start or stop certain events in the viewing device; and
6) a unused bit (1 bit) that may be used for expansion purposes.

TABLE 1

50 bit Packet Contents

| Channel ID | Type | Media ID | Timecode | trigger | Unused bit | Channel ID Range | Media ID Range | Timecode Range |
|---|---|---|---|---|---|---|---|---|
| 16 bits | 0 | 24 bits | 7 bits | 1 bit | 0 | 0-2^16 | 0-2^24 | 2.58 minutes |
| 16 bits | 1 | 20 bits | 11 bits | 1 bit | 0 | 0-2^16 | 0-2^20 | 40.76 minutes |

The demodulator computes soft bits $\hat{d}_n[k]$ (with values in the interval [−1,1]) and weights $\gamma_n(k)$ from the received audio signal as described previously. When error correction coding is applied by the modulator, these values are in combination with a corresponding error correction decoder to decode the source bits. In an exemplary system 1300 shown in FIG. 13, soft bits (1305) and weights (1310) are computed from the STFT data at 28 different sample times and the soft bits and weights are combined using a weighted sum 1315 over all the phase values representing the same channel bit (i.e., over the replicated bits). The result is 168 combined soft bits and combined weights (1320) that are input to a Vitterbi type convolutional decoder 1325 that outputs a decoded packet or payload (1330) of 50 decoded source bits plus 6 decoder CRC bits. In addition the Vitterbi decoder 1325 outputs a log likelihood measure (1335) indicative of the decoder's confidence in the accuracy of the decoded payload (1330). This log likelihood measure is processed using a sum of weights divider 1340 to produce a detection metric (1345). A payload detection module 1350 uses the detection metric (1345) in combination with the decoded CRC bits to determine if the decoded payload is valid (i.e., information bits are present in the audio signal) or invalid (i.e., no information bits are present in the audio signal). Typically, if the packet reliability measure is too low or if the decoded CRC does not match with that computed from the decoded source bits, then the packet is determined to be invalid. Otherwise, it is determined to be valid. For valid packets, the 50 decoded source bits (1355) are the output of the demodulator (i.e the payload) in this exemplary system. Many variations are possible, including different numbers of bits, different forms of error correction or error detection coding, different repetition strategies and different methods of computing soft bits and weights.

Synchronization

The modulator may reserve some symbol intervals for synchronization or other data. During such synchronization intervals, the modulator inserts a sequence of synchronization bits that are known by both the modulator and demodulator. These synchronization bits reduce the number of symbol intervals available to convey information, but facilitate synchronization at the receiver. For example, the modulator may reserve certain STFT frequency coefficients, and modulate a known bit pattern into the phases of these reserved coefficients. In this case the demodulator synchronizes itself with the data stream by searching for the known synchronization bits within the STFT phase values. Once the demodulator finds one or more instances of the synchronization pattern (making some allowances for bit errors), the demodulator can further improve synchronization reliability by performing channel decoding on one or more packets and using an estimate of the number of bit errors in the decoded packet(s) or some other measure of channel quality as a measure of synchronization reliability. If the estimated number of bit errors is less than a detection threshold value, synchronization is established. Otherwise the demodulator continues to check for synchronization using the aforementioned procedure.

In systems where no symbols are reserved for synchronization, or where the number of such reserved symbols is insufficient, the demodulator may use channel coding to synchronize itself with the data stream. In this case, channel decoding is performed at each possible time offset and an estimate of channel quality is made for each such offset. The offset with the best channel quality is compared against a threshold and, if the channel quality exceeds a preset detection threshold, then the demodulator uses the corresponding time offset to synchronize itself with the data stream. However, if the best channel quality is below the detection threshold, then the demodulator determines that watermark data does not exist at that time offset.

The detection threshold used in synchronization may be set to trade off false detections (i.e., detecting a watermark packet when none exists) relative to missed detections (i.e., not detecting a packet where it does exist). One method of determining the detection threshold is to create a database and measure the false detection rate and/or the missed detection rate relative to the detection threshold. The detection threshold may then be set using the measured data to achieve the desired false detection rate and/or the missed detection rate.

Figure 11:
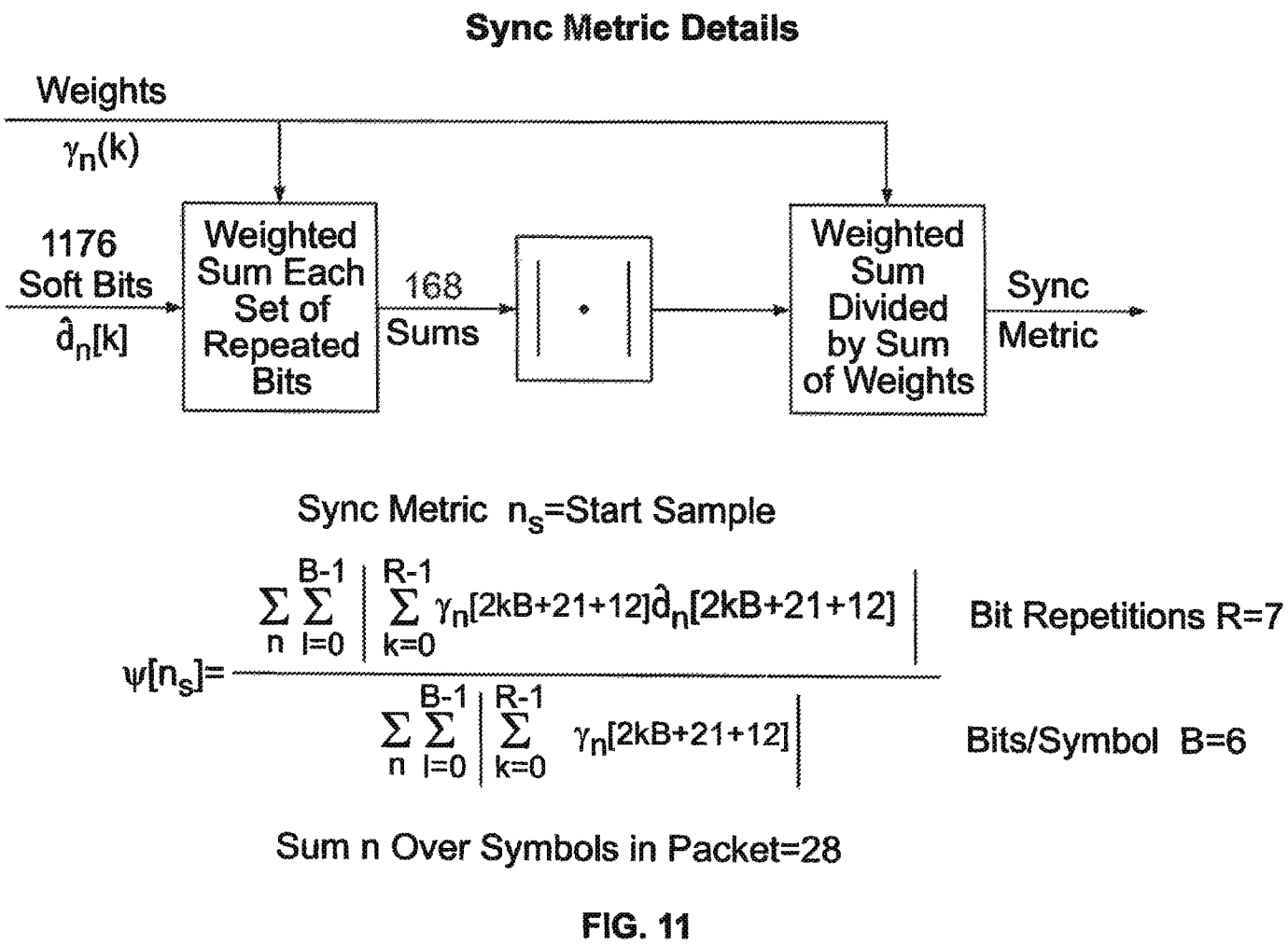
FIG. 11 illustrates computation of a synchronization metric.

When bit replication is used as part of the channel coding method, the repeated bits may be used to aid synchronization. As discussed above, an exemplary system transmits a payload of 50 bits with 6 CRC bits for a total of 56 source bits. A 1:3 convolutional code produces 168 bits with increased error protection. Each of these bits may be repeated 7 times to produce 1176 bits with further error protection. An exemplary method modulates a first group of 7 repeated bits at FFT frequency samples 12, 24, 36, 48, 60, 72, 84, a second group of 7 repeated bits at samples 14, 26, 38, 50, 62, 74, 86, and so on, with the sixth and final group at samples 22, 34, 46, 58, 70, 82, 94. Synchronization proceeds by selecting a starting sample for the packet and computing the soft demodulated bits $d_n[k]$ and weights $\gamma_n(k)$ as described above. The metric $$\psi[n_s] = \frac{\sum_n \sum_{l=0}^{B-1} \sum_{k=0}^{R-1} \gamma_n[2kB + 2l + 12]\hat{d}_n[2kB + 2l + 12]}{\sum_n \sum_{l=0}^{B-1} \sum_{k=0}^{R-1} \gamma_n[2kB + 2l + 12]}$$

may be computed where $n_s$ is the selected start sample, R is the number of bit repetitions with an exemplary value of 7, and B is the number of bits per symbol (or modulation time) with unused interdependence in order to reduce synchronization complexity. An exemplary system sums n over the number of symbols in the packet (for example 28). This method of computing a synchronization metric is shown in FIG. 11.

One method of synchronization involves finding the start sample $n_s$ for which the metric $\psi[n_s]$ is maximized. This metric tends to have a slowly changing DC component as well as a slowly amplitude modulated high frequency component near 17 KHz and must be sampled at a high rate to achieve adequate synchronization accuracy.

A second method computes additional metrics $\psi_1[n_s]$, $\psi_2[n_s]$, and $\psi_3[n_s]$ which differ from $\psi[n_s]$ in that different quantizer offsets $\beta_n[k]$ are used. The metric $\psi_m[n_s]$ adds $\pi m/4N_k$ to the quantizer offsets $\beta_n[k]$. A complex metric may be formed $$\psi_c[n_s]=\psi[n_s]-\psi_2[n_s]+j(\psi_1[n_s]-\psi_3[n_s])$$

which has several advantages. The magnitude $|\psi_c[n_s]|$ tends to have a smaller bandwidth than $\psi[n_s]$ so that it may be sampled at a lower rate requiring less complexity. In addition, the phase of $\psi_c[n_s]$ together with knowledge of the dominant frequency may be used to obtain an accurate estimate of the start sample $n_s$.

A third advantage is that a low autocorrelation sidelobe sequence such as a m-sequence may be used to improve packet synchronization. When a zero in the sequence is encountered, $\pi/2N_k$ is added to the quantizer offsets $\beta_n[k]$ for the current modulation time, and when a one in the sequence is encountered, the quantizer offsets are left unchanged. An exemplary system with 28 symbols per packet, uses the sequence [1000111100010001000100101101] in this manner.

To achieve low synchronization complexity, reduction of the sampling rate for the complex metric $\psi_c[n_s]$ is desirable. Good synchronization performance may be maintained down to sampling rates near 12 KHz using the following method of the complex metric, if this is less than a synchronization threshold $T_s$ (with exemplary value 0.004) then stop of the complex metric $\psi_c[n_s]$, estimate the times at which a phase of zero occurs is an integer. To achieve low synchronization complexity, reduction of the sampling rate for the complex metric $\psi_c[n_s]$ is desirable. Good synchronization performance may be maintained down to sampling rates near 12 KHz using the following method:

1) Find the maximum of the magnitude $|\psi_c[n_s]|$ of the complex metric, if this is less than a synchronization threshold $T_s$ (with exemplary value 0.004) then stop.

2) Determine the phase $\theta_\psi[n_s]$ of the complex metric $\psi_c[n_s]$.

3) Using knowledge of the dominant frequency $f_D$, estimate the times at which a phase of zero occurs $$t_\psi[n_s] = \frac{-\theta_\psi[n_s] \pm 2\pi k}{2\pi f_D}$$

where k is an integer.

4) Only use the estimated times within ½ sample of the maximum magnitude as packet start candidates.

5) Repeat steps 1-4, disregarding previously used maxima, until the desired number of candidates are obtained.

In-Sync Detector

Figure 12:
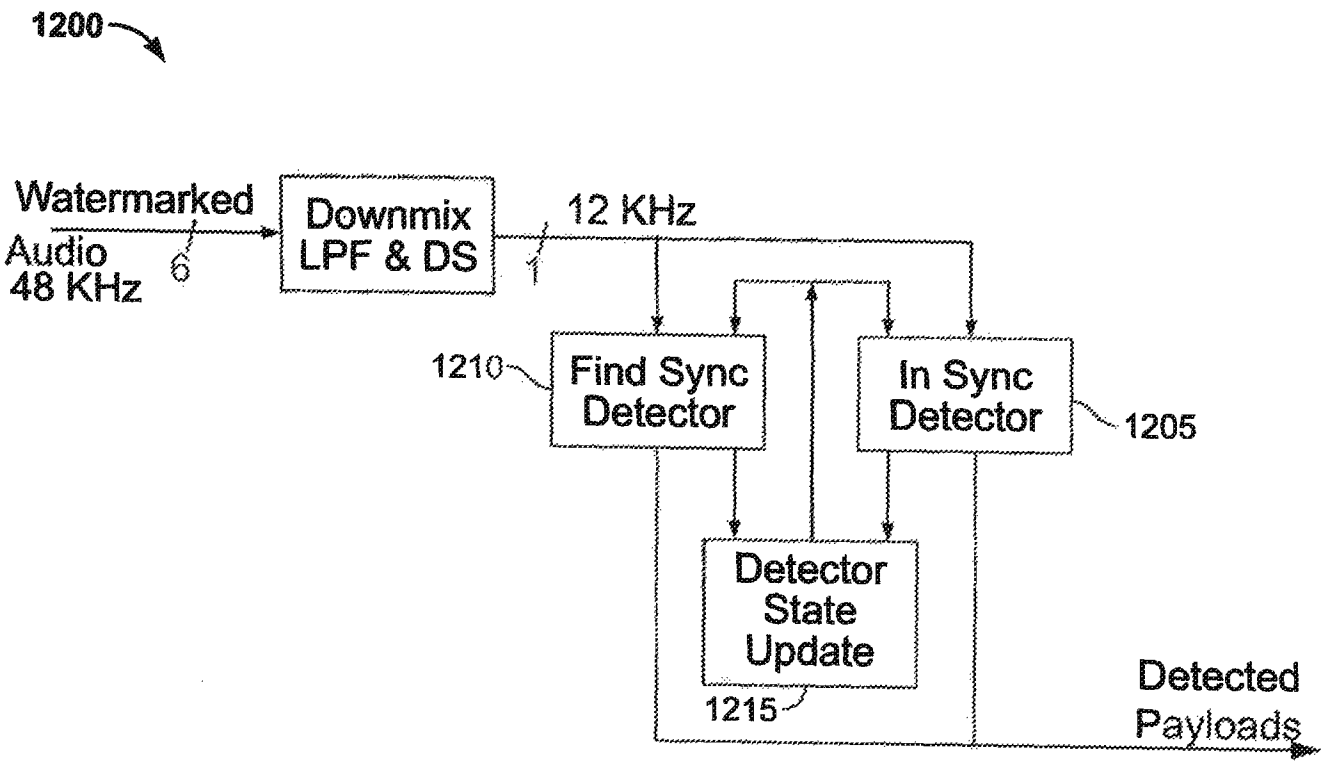
FIG. 12 is a block diagram of an audio watermark detector.

Referring to FIG. 12, to further improve performance, a detector/demodulator 1200 maintains detector state information which includes information on the current synchronization state, and uses this detector state information to alter the processing for subsequent packets. The current synchronization state is based on whether recent packets received by the demodulator meet certain detection criteria. The synchronization state is a binary quantity taking on the value of "in-sync" to indicate the demodulator is currently synchronized with the received audio signal, and "out-of-sync" to indicate that the demodulator is not currently synchronized with the received audio signal. Since the modulator typically modulates a packet of encoded payload data at a known time offset from a previously modulated packet of encoded payload data, the start time of subsequent packets can be predicted from the packet start time of a previous packet.

When the synchronization state is in-sync, the demodulator 1200 uses an in sync detector 1205 that skips the additional synchronization processing, computes a predicted start time for the next data packet based on the start time of the prior data packet and the known spacing between packets, and then uses this predicted start time to demodulate the next data packet. Alternately, when the synchronization is out-of-sync, the demodulator 1200 uses a find sync detector 1210 that performs additional synchronization processing to determine the start time of the next data packet, using, for example, the low complexity synchronization method described previously as the sync metric, and demodulates the next data packet using this new start time. In either case, the synchronization state is updated (1215) after demodulation based on a packet detection metric computed from the next data packet. If the packet detection metric indicates the next packet is valid data, then the synchronization state is set to in-sync, while if the packet detection metric indicates the next packet is invalid, then the synchronization state is set to out-of-sync.

Figure 13:
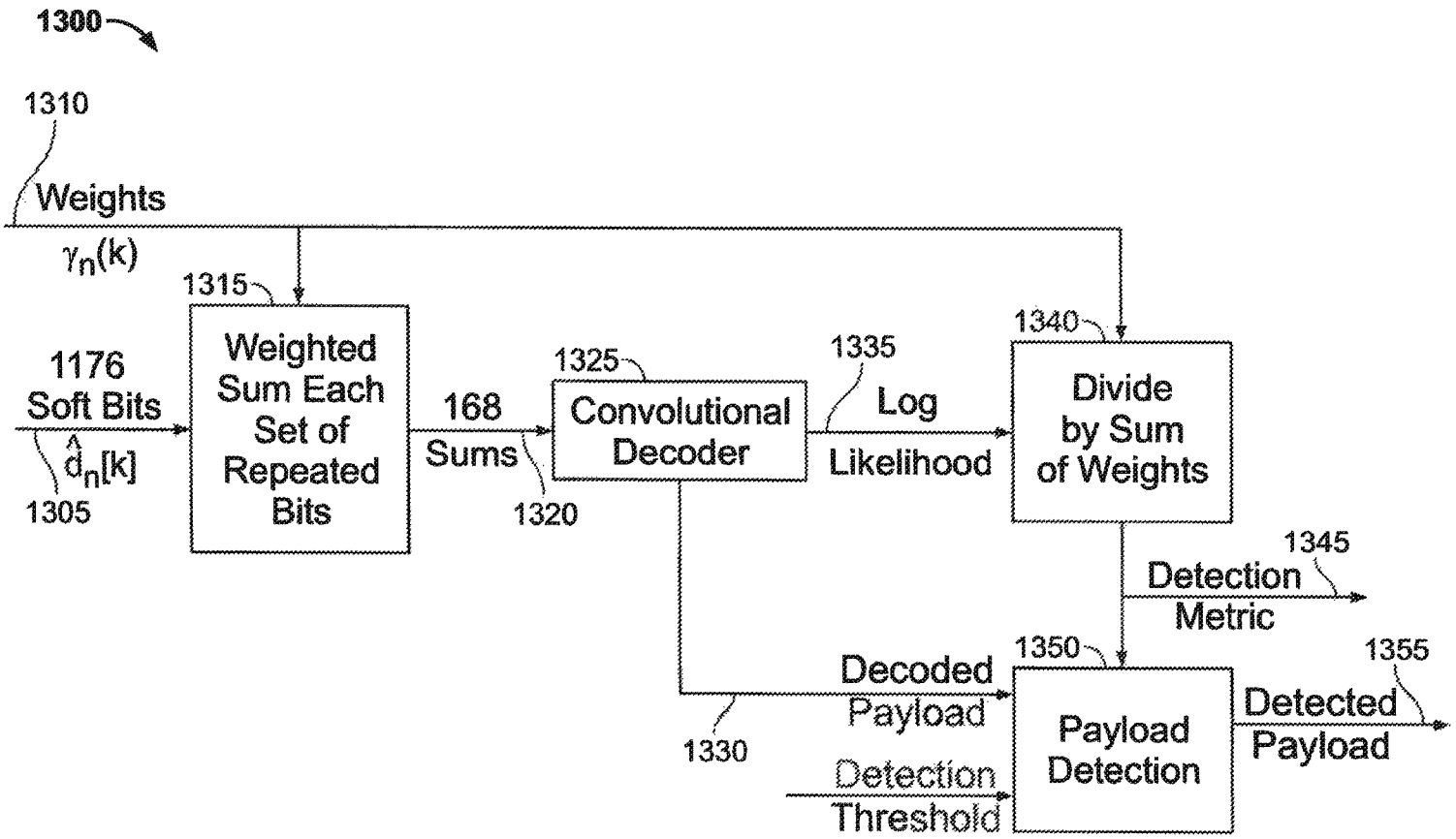
FIG. 13 is a block diagram of a synchronization detection metric.

In one implementation, as shown in FIG. 13 the detection metric (1345) is computed as a normalized log-likelihood after FEC decoding of the packet. If this detection metric is below a specified detection threshold, and the CRC in the data packet indicates no errors, then the packet is considered valid (i.e., a payload detection is declared) and is output from the demodulator Otherwise, if either condition fails, then the packet is considered invalid, and no data is output from the demodulator. This last condition when no data is output from an invalid packet also prevents the false output of data when an unmarked audio signal is input to the demodulator.

Figure 14:
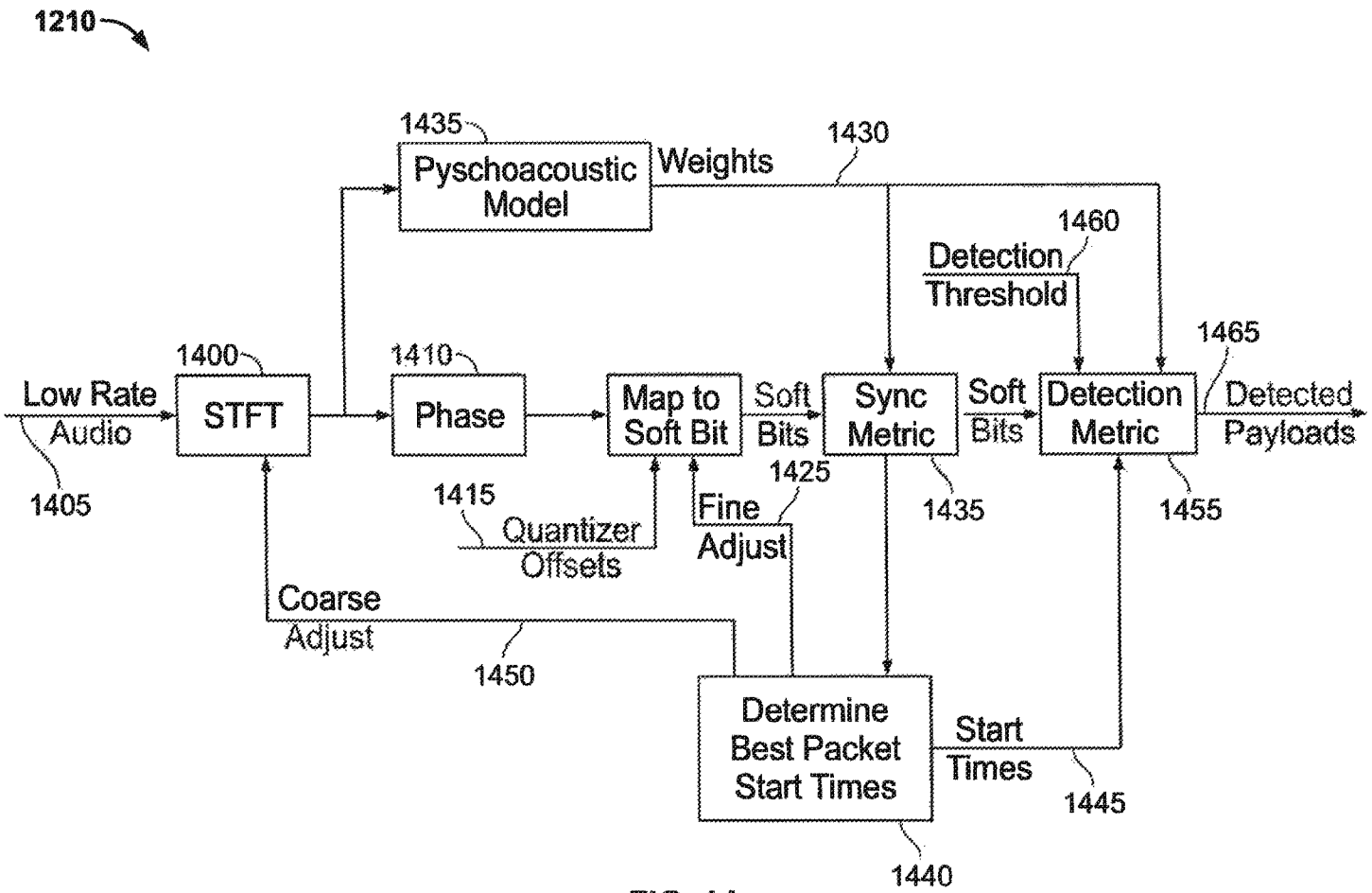
FIG. 14 is a block diagram of a find sync detector.

FIG. 14 illustrates an implementation of the find sync detector 1210. In this implementation, the STFT 1400 of a low rate audio signal (1405) such as the output of a downmix, low pass filter, and downsample operation is computed at a set of coarse start times. In order to reduce computation, these start times may be spaced by more than one sample with a typical spacing of 16 samples for a sampling rate of 12 KHz.

A phase 1410 of the STFT result is determined and used in conjunction with quantizer offsets (1415) to map 1420 the STFT results to soft bits. This mapping may apply a fine adjustment (1425) to the start time as a linear phase offset to the phase of the STFT. A typical spacing for the fine adjustment of start times is one sample at 12 KHz. The resulting adjusted phases may be mapped to the soft bits. The soft bits may be weighted by a set of weights (1430) produced by a psychoacoustic model 1435 in computing a sync metric 1435. A set of sync metric samples above a synchronization threshold may be used to determine 1440 a set of packet start times (1445), and to determine the fine adjustment (1425) and a coarse adjustment (1450) of the start time that is used by the STFT 1400. A detection metric 1455 may be evaluated at this set of packet start times. The detection metric may be compared to a detection threshold (1460) to determine the validity of a detected payload (1465).

In addition to predicting the start time for the next packet, portions of the payload (i.e., the actual data bits) may be predicted from previous packets. If the predicted portion of the payload is different from the decoded payload, the decoded payload may be rejected and the mode changed to synchronization. If the predicted portion of the payload is the same as the decoded payload, the detection threshold may be decreased to reduce the probability of a missed detection while maintaining a low false alarm rate.

When the mode is changed from in-sync to out-of-sync, it is possible that a different audio channel was presented to the watermark detector with different packet start times. For this case, it may be desirable to preserve a buffer of audio samples so that synchronization may proceed immediately after the last detected packet. This reduces the probability of missed detections near the mode change.

In another implementation, rather than modifying phases, the modulator adds small echoes of the audio signal to modify the correlation toward a target value. Small echoes were selected because consumers have extensive experience with listening with environmentally generated echoes which reduces the risk of consumer detectable content quality degradation due to the watermark. The modulator measures the correlation value at multiple delays, and then modifies the measured correlation value toward a desired target correlation value to embed some number of information bits into the audio signal. The correlation is measured and modified at 3 different delays within each 6.25 ms symbol interval, allowing 480 bits per second to be embedded into each channel of the audio signal. Adjustment of the symbol interval, or the number of delays per interval, or the target values can be used to vary the number of bits per second embedded into the audio signal.

The demodulator detects the information bits transmitted by measuring the correlation at each delay value and comparing them to the energy in the symbol. This simple demodulator reduces the viewing device computational requirements.

The performance of this modulator/demodulator pair has been measured using a 1 hour mono recording of a variety of television audio material. When no transcoding is present between the modulator and demodulator a bit error rate of 1.5% was measured. With a 64 Kbps AAC Coder/Decoder present, a bit error rate of 5.3% was measured.

To determine performance for payloads such as the Channel Identification, 40 bits of source information were encoded to produce 120 bits of channel data using a punctured rate 3 convolutional code. These 120 bit blocks were modulated onto 0.25 seconds of audio using 40 consecutive 3 bit symbols. To measure block error performance, these blocks were modulated onto about 1 hour of television audio material. The modulated audio was then transcoded using a 64 Kbps AAC Coder/Decoder. The transcoded audio was then demodulated and a block error metric computed using a convolutional decoder. To determine performance statistics, the block error metric was computed for each start sample and the minimum block error metric over an observation window was selected. If the minimum block error metric was above a threshold, the observation interval was marked a no detect. If the minimum block error metric was below the threshold, the decoded data was then checked against the source data and marked good if equal or bad otherwise.

| Observation Window | Good Blocks | Bad Blocks | No Detects |
|---|---|---|---|
| 0.25 sec | 14503 | 34 | 87 |
| 0.5 sec | 14823 | 7 | 34 |
| 0.75 sec | 14880 | 2 | 34 |
| 1.0 sec | 14898 | 1 | 16 |
| 2.0 sec | 14909 | 0 | 2 |

This data helps to demonstrate expected performance for recognizing a channel change.

Demodulator

A sampled signal $\hat{r}[n]$ is received by the demodulator. Exemplary parameters will be given for a sampling rate of 48 KHz. A window w[n] is applied to the received signal to produce a windowed received signal $x_K[n]=w[n-kN]\hat{r}[n]$ where k is the symbol index. The window is of length N and is zero outside the interval of [0, N −1]. An exemplary choice for w[n] is a tapered window of length 300 samples such as a Kaiser window with parameter 5.0.

A correlation is computed at lag $l_i$ as follows:

$$q_k[l_i] = \sum_n x_k[n]x_k[n+l_i]$$

Demodulated Bits $d_i(k)$ (which may have a value of 0 or 1) are chosen to minimize the distance between the computed correlation and its quantized value where the quantized value depends on $d_i(k)$. In particular $d_i(k)$ may be selected minimize $[q_k[l]-Q(q_k[0], q_k[l], d,[k])]$ where $$Q(q_0, q_l, b) = \left\lfloor \frac{q_l}{q_0 S} - b/2 + 3/4 \right\rfloor q_0 S + q_0 S(b - 1/2)/2$$

is a bit dependent quantization function, [x] is the floor function (which returns the greatest integer <=x), and S is the quantizer step size (with an exemplary value of 0.2). This quantization function has one set of quantization levels when the bit transmitted is a 0 and a different set of quantization levels when the bit transmitted is a 1.

Soft demodulated bits $\hat{d}_i(k)$ (with values in the interval [0, 1]) may be computed $\hat{d}_i[k]=D(q_k[0], q_k[l])$ where an exemplary soft demodulation function is $$D(q_0, q_l) = \begin{cases} \dfrac{2|Q(q_0, q_l, 0) - q_l|}{Sq_0}, & |Q(q_0, q_l, 0) - q_l| < |Q(q_0, q_l, 1) - q_l| \\ 1 - \dfrac{2|Q(q_0, q_l, 1) - q_l|}{Sq_0}, & \text{else} \end{cases}$$

It is often advantageous to compute weights $\gamma_i(k)$ for the soft demodulated bits $\hat{d}_i(k)$ to improve the error correction performance of the channel decoder. For example, higher bit error rates are expected in regions of low amplitude due to lower signal to noise ratios in these regions. Weights which depend on energy such as $$\gamma_i(k)=q_k[0]$$

or root mean square energy such as $$\gamma_i(k)=\sqrt{q_k[0]}$$

can be used to improve performance in these regions. In addition, error statistics for bits modulated on particular lags may be estimated and used to modify the weights so that lags with lower estimated bit error rates have higher weights than lags with higher estimated bit error rates. Error statistics as a function of audio signal characteristics may also be estimated and used to modify the weights. For example, the modulator may be used to estimate the demodulation error for a particular segment of the audio signal and lag and the weights may be decreased when the estimated demodulation error is large.

Modulator

A sampled signal s[n] is received by the modulator. Exemplary parameters will be given for a sampling rate of 48 KHz. The modulator adds echoes to the signal to modify the correlation at a set of lags $l_i$ (with exemplary values of $l_1=89$, $l_2=67$, $l_3=45$). A sequence of bits $b_i[k]$ is also received by the modulator where k is the symbol index. The bits $b_i[k]$ together with the current correlation values determine the target correlation values for the modulator.

The echoes that are added may be obtained by windowing delayed or advanced versions of the received signal:

$$e_{i,j,k}[n]=v_j[n-kN]s[n-m_i]$$

where $m_i$ are the echo lags and may be positive for a delay or negative for an advance and $v_j[n]$ are the echo windows which typically are of length M and are zero outside the interval of [0,M−1]. Exemplary choices for the echo windows include the window w[n] in addition to windows which have more energy at the beginning or end of the interval.

The modulator multiplies the echoes by gains $g_{i,j}[k]$ to produce a modulated signal $$r[n] = s[n] + \sum_k \sum_i \sum_j g_{i,j}[k]e_{i,j,k}[n].$$

For a particular symbol index k, there are typically only 3 nonzero gains. In addition, the gains are limited to the interval [−G,G] where an exemplary value of G is 0.2 to limit quality impact.

The modulator selects the gains by minimizing the demodulation error $$E_k = \sum_i |D(q_k[0], q_k[l_i]) - b_i[k]|$$

where the correlation is computed at lag $l_i$ using $$q_k[l_i] = \sum_n x_k[n]x_k[n+l_i]$$

and the window modulated signal is $x_k[n]=w[n-kN]r[n]$. The window w[n] is described in the demodulator section.

A useful procedure for minimizing this error is to hold all of the gains constant except for one. A quadratic equation may then be solved to find the minimum over this gain. The procedure may be repeated by choosing a different gain to vary while holding the others constant. A small number of iterations is usually sufficient to produce adequate results using this method.

The windowed modulated signal may be expanded to $$x_k[n]=r_{i,j,k}[n]+g_{i,j}[k]f_{i,j,k}[n]$$

where the windowed base modulated signal $r_{i,j,k}[n]$ is the windowed modulated signal r[n] with gain component $g_{i,j}[k]$ set to zero and $f_{i,j,k}[n]$ are the windowed echoes given by $f_{i,j,k}[n]-w[n-kN]e_{i,j,k}[n]$.

It may be advantageous to decorrelate the windowed echoes against the windowed signal.

A target correlation ratio may be computed from the windowed base modulated signal $r_{i,j,k}[n]$ using the bit dependent quantization function $$\rho_k[l] = \frac{Q(\hat{q}_0, \hat{q}_l, b_i[k])}{\hat{q}_0}$$

where the windowed base modulated signal correlations are computed using $$\hat{q}_l = \sum_n r_{i,j,k}[n]r_{i,j,k}[n+l]$$

Target correlation ratios for quantizer steps near the value returned by the bit dependent quantization function may produce a smaller demodulation error. So, it is often advantageous to add or subtract the quantizer step size S from the target correlation ratio to generate addition candidates for evaluation.

The objective is to produce a modulated signal with correlation ratio $$\frac{q_k[l]}{q_k[0]}$$

equal to the target correlation ratio $\rho_k[l]$:

$$\rho_k[l] = \frac{\sum_n (r_{i,j,k}[n] + g_{i,j}[k]f_{i,j,k}[n])(r_{i,j,k}[n+l] + g_{i,j}[k]f_{i,j,k}[n+l])}{\sum_n (r_{i,j,k}[n] + g_{i,j}[k]f_{i,j,k}[n])^2}$$

This equation is quadratic in the varied gain component $$ag_{i,j}^2[k] + bg_{i,j}[k] + c = 0$$

Where the coefficients are given by:

$$a = \sum_n f_{i,j,k}[n]f_{i,j,k}[n+l] - \rho_k[l]\sum_n f_{i,j,k}^2[n]$$

$$b = \sum_n r_{i,j,k}[n]f_{i,j,k}[n+l] + \sum_n r_{i,j,k}[n+l]f_{i,j,k}[n] - 2\rho_k[l]\sum_n r_{i,j,k}[n]f_{i,j,k}[n]$$

-continued $$c = \sum_n r_{i,j,k}[n]r_{i,j,k}[n+l] - \rho_k[l]\sum_n r_{i,j,k}^2[n].$$

There are several cases for the solutions of this quadratic equation:

1) There are no real solutions. For this case, no update is performed for this gain component.
2) There are two real solutions. For this case, the solution with smallest absolute value is selected for further evaluation.
3) There is one real solution.

For cases 2 and 3, the solution is limited to the interval [−G,G] and the demodulation error is computed:

$$E_k = \sum_i |D(q_k[0], q_k[l_i]) - b_i[k]|$$

For each symbol, the set of gains which produce the smallest demodulation error is selected to produce the final modulated signal for transmission.

Synchronization

The modulator may reserve some symbol intervals for synchronization or other data. During such synchronization intervals, the modulator inserts a sequence of synchronization bits that are known by both the modulator and demodulator. These synchronization bits reduce the number of symbol intervals available to convey information, but facilitate synchronization at the receiver. For example, the modulator may reserve 6 symbol intervals out of each 120, and insert a known bit pattern into these 6 synchronization symbols. The demodulator synchronizes itself with the data stream by searching for the known synchronization symbols within the data. Once the demodulator finds one or more instances of the synchronization pattern (making some allowances for bit errors), the demodulator can further improve synchronization reliability by performing channel decoding on one or more data blocks and using an estimate of the number of bit errors in the decoded block(s) or some other measure of channel quality as a measure of synchronization reliability. If the estimated number of bit errors is less than a threshold value, synchronization is established. Otherwise the demodulator continues to check for synchronization using the aforementioned procedure. Note that in systems where no symbols are reserved for synchronization, the demodulator uses channel coding to synchronize itself with the data stream. In this case channel decoding is performed at each possible offset and an estimate of channel quality is made vs offset. The offset with the best channel quality is compared against a threshold and if it exceeds a preset threshold, then the demodulator uses the corresponding offset to synchronize itself with the data stream.

Watermark Layering

In addition to synchronization, the modulator may reserve some symbol intervals to support layering of watermarks or other purposes. For example, the modulator may reserve every other block of 120 symbols to support the insertion of additional watermarks into the signal at a later stage. This concept extends to multichannel signals (such as 2 channel stereo, or 5.1 channel surround sound), where the modulator may only use a subset of the channels or linear combinations thereof, to convey information, reserving the other channels or linear combinations for other purposes including the conveyance of other watermark data.

Layering of watermarks may also be supported by filtering the signal. For example a low pass or other filter may be used to limit the audio frequencies used to convey the data, leaving the unused frequencies available to convey other watermark data. One specific case of interest involves frequencies in the approximate 4.8-6 kHz range which may contain embedded data for audience measurement in some television applications. Filtering out this frequency range from the echoes added to the audio signal by the modulator leaves any audience measurement data already embedded in this band unmodified while still allowing the audio signal to convey other information as described herein.

This alternative technique may be used to convey information using an audio channel by modulating an audio signal including audio information to produce a modulated signal including the audio information and additional information, and demodulating the modulated signal to extract the audio information and the additional information, where modulating the audio signal includes adding small echoes of the audio signal to the audio signal to produce the modulated signal. The modulated signal may be encoded using error correction coding to produce an encoded signal, and the encoded signal may be decoded to produce the modulated signal. Modulating the audio signal may include producing an intermediate signal using the audio signal, measuring a correlation value of the intermediate signal at multiple delays, and modifying the measured correlation value toward a desired target correlation value to embed information bits into the modulated signal. Measuring the correlation value of the intermediate signal may include doing so at, for example, three different delays, and comparing the correlation at each delay to the energy in a symbol. The systems and techniques described above are not limited to any particular hardware or software configuration. Rather, they may be implemented using hardware, software, or a combination of both. In addition, the methods and processes described may be implemented as computer programs that are executed on programmable computers comprising at least one processor and at least one data storage system. The computer programs may be implemented in a high-level compiled or interpreted programming language, or, additionally or alternatively, the computer programs may be implemented in assembly or other lower level languages, if desired. Such computer programs typically will be stored on computer-usable storage media or devices. When read into a processor of a computer and executed, the instructions of the programs may cause a programmable computer to carry out the various operations described above.

A number of implementations have been described. Nevertheless, it will be understood that various modifications may be made. For example, useful results still may be achieved if aspects of the disclosed techniques are performed in a different order and/or if components in the disclosed systems are combined in a different manner and/or replaced or supplemented by other components. Accordingly other implementations are within the scope of the following claims.

What is claimed is:

1. A watermark decoder that decodes watermark information that is embedded in a watermarked audio signal, the watermark decoder being configured to:

segment the watermarked audio signal into overlapping segments using a non-uniform analysis window function;

transform a windowed segment to form frequency coefficients that are represented by magnitude and phase values; and extract an information bit of the watermark information from one or more of the phase values by determining whether the one or more of the phase values are closer to a first set of phase quantization values representing a first value for the information bit or a second set of phase quantization values representing a second value for the one or more information bits.

2. The watermark decoder of claim 1, wherein the watermark decoder is configured to extract an information bit of the watermark information from the phase values by:

combining phase values from multiple frequency coefficients into an aggregate phase value; and mapping the aggregate phase value to a received channel bit based on which of one or more subsets of phase quantization values includes a phase quantization value that is closest to the aggregate phase value.

3. The watermark decoder of claim 2, wherein combining phase values from multiple frequency coefficients into the aggregate phase value comprises:

scaling each phase value in proportion to a phase constellation size corresponding to the frequency represented by the phase value, adding a phase offset to each scaled phase value to produce shifted phase values, and computing a weighted sum of the shifted phase values to form the aggregate phase value.

4. The watermark decoder of claim 3, wherein the phase offset added to a scaled phase value to produce a shifted phase value is determined for a particular segment according to a known time sequence.

5. The watermark decoder of claim 1, wherein the watermark decoder is configured to synchronize to the watermarked audio signal by:

segmenting the watermarked audio signal for multiple different segmentation offsets, extracting one or more information bits of the watermark information for each of the multiple different segmentation offsets, and using the extracted information bits for each segmentation offset to determine the segmentation offset representing the best alignment with the watermarked audio signal.

6. The watermark decoder of claim 1, wherein the non-uniform analysis window used to produce the windowed segments in the watermark decoder is matched to a window function used to embed the watermark information in the watermarked audio signal.

7. The watermark decoder of claim 1, wherein the watermark decoder is configured to transform multiple segments and extract information bits of the watermark information from multiple transformed segments, and the transformed segments from which information bits are extracted do not overlap with one another.

8. The watermark decoder of claim 1, wherein the watermark decoder is configured to:

synchronize with the watermarked audio signal by:

repeatedly performing the segmenting, transforming and extracting at a first frequency to form synchronization information bits, assessing validity of the synchronization information bits, and determining that the watermark decoder is synchronized with the watermarked audio signal upon determining that the synchronization information bits are valid; and repeatedly perform the segmenting, transforming and extracting at a second frequency to form extraction information bits, wherein the first frequency is greater than the second frequency.

* * * * *